US010678176B2

(12) United States Patent
Tomii et al.

(10) Patent No.: US 10,678,176 B2
(45) Date of Patent: Jun. 9, 2020

(54) IMAGE FORMING APPARATUS FOR DETECTING FAULT LOCATION

(71) Applicant: CANON KABUSHIKI KAISHA, Tokyo (JP)

(72) Inventors: Hiroshi Tomii, Kashiwa (JP); Toshihisa Yago, Toride (JP); Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/049,844

(22) Filed: Jul. 31, 2018

(65) Prior Publication Data

US 2019/0041785 A1 Feb. 7, 2019

(30) Foreign Application Priority Data

Aug. 4, 2017 (JP) ..... 2017-151758

(51) Int. Cl.

| | |
|---|---|
| ***G03G 15/00*** | (2006.01) |
| ***G03G 15/08*** | (2006.01) |
| ***G03G 15/04*** | (2006.01) |
| ***G03G 15/01*** | (2006.01) |

(Continued)

(52) U.S. Cl.

CPC ..... *G03G 15/5058* (2013.01); *G03G 15/0121* (2013.01); *G03G 15/04* (2013.01); *G03G 15/0808* (2013.01); *G03G 15/5016* (2013.01); *G03G 15/0266* (2013.01);

(Continued)

(58) Field of Classification Search

CPC ..... G03G 15/5058; G03G 15/0121; G03G 15/04; G03G 15/0808; G03G 15/5016; G03G 15/5062; G03G 15/55; G03G 15/0266; G03G 15/065; G03G 2215/00042

See application file for complete search history.

(56) References Cited

U.S. PATENT DOCUMENTS

| | | | |
|---|---|---|---|
| 5,481,337 | A | 1/1996 | Tsuchiya et al. |
| 9,055,264 | B2 | 6/2015 | Horita |
| 9,678,463 | B2 | 6/2017 | Tanaka |

(Continued)

FOREIGN PATENT DOCUMENTS

| | | | |
|---|---|---|---|
| EP | 2 950 152 | A2 | 12/2015 |
| JP | 2017-083544 | A | 5/2017 |

OTHER PUBLICATIONS

Extended European Search Report dated Nov. 15, 2018, in European Patent Application No. 18185486.0.

(Continued)

*Primary Examiner* — Joseph S Wong
(74) *Attorney, Agent, or Firm* — Venable LLP

(57) ABSTRACT

A controller controls a first image forming unit and a second image forming unit to form a test image having a pattern. The test image is formed by the first image forming unit based on a first image forming condition in which an absolute value of a developing potential of a first developing sleeve is greater than an absolute value of a charging potential of a first photosensitive member. The pattern is formed by a second image forming unit based on a second image forming condition in which an absolute value of a developing potential of a second developing sleeve is smaller than an absolute value of a charging potential of a second photosensitive member. A controller controls a sensor to read the test image having the pattern.

22 Claims, 25 Drawing Sheets

(51) Int. Cl.
*G03G 15/02* (2006.01)
*G03G 15/06* (2006.01)

(52) U.S. Cl.
CPC ..... *G03G 15/065* (2013.01); *G03G 15/5062* (2013.01); *G03G 15/55* (2013.01); *G03G 2215/00042* (2013.01)

(56) References Cited

U.S. PATENT DOCUMENTS

| | | | | |
|---|---|---|---|---|
| 2008/0101808 | A1 | 5/2008 | Shih et al. | |
| 2008/0126860 | A1* | 5/2008 | Sampath ..... | G03G 15/0194 714/25 |
| 2008/0145079 | A1 | 6/2008 | Cho | |
| 2010/0143006 | A1 | 6/2010 | Yamada et al. | |
| 2010/0278548 | A1* | 11/2010 | Burry ..... | G03G 15/0258 399/49 |
| 2011/0158668 | A1 | 6/2011 | Fuse et al. | |
| 2015/0192884 | A1 | 7/2015 | Sone | |
| 2015/0346627 | A1 | 12/2015 | Okugawa et al. | |
| 2016/0117576 | A1 | 4/2016 | Horita | |
| 2017/0219979 | A1 | 8/2017 | Arimoto | |
| 2017/0308017 | A1 | 10/2017 | Tomii | |
| 2018/0046113 | A1 | 2/2018 | Katahira et al. | |

OTHER PUBLICATIONS

Extended European Search Report dated Nov. 15, 2018, in European Patent Application No. 18185488.6.
Extended European Search Report dated Nov. 15, 2018, in European Patent Application No. 18185490.2.

* cited by examiner

FIG. 7

| STREAK TYPE | REPLACEMENT PART | PLAIN PORTION W | PATTERN WHERE STREAK OCCURS | DIGITAL PATTERN | ANALOG PATTERN | IMPACT OF LOWERING CHARGING POTENTIAL |
|---|---|---|---|---|---|---|
| DEVELOPING COAT DEFECT STREAK | DEVELOPING UNIT FOR COLOR OF OCCURRENCE | NO STREAK | ONLY COLOR OF OCCURRENCE | STREAK PRESENT | STREAK PRESENT | NO IMPACT |
| EXPOSURE DEFECT WHITE STREAK | EXPOSURE APPARATUS FOR COLOR OF OCCURRENCE (CLEANING MAINTENANCE) | NO STREAK | ONLY COLOR OF OCCURRENCE | STREAK PRESENT | NO STREAK | NO IMPACT |
| CHARGE DEFECT STREAK | PROCESS CARTRIDGE FOR COLOR OF OCCURRENCE | NO STREAK | ONLY COLOR OF OCCURRENCE | STREAK PRESENT | STREAK PRESENT | STREAK IMPROVED |
| BELT PLASTICITY DEFORMATION STREAK | INTERMEDIATE TRANSFER UNIT | NO STREAK | ALL COLORS | STREAK PRESENT | STREAK PRESENT | NO IMPACT |
| DRUM CLEANING DEFECT STREAK | PROCESS CARTRIDGE FOR COLOR OF OCCURRENCE | STREAK PRESENT (MONOCHROME) | ALL COLORS | STREAK PRESENT | STREAK PRESENT | NO IMPACT |
| BELT CLEANING DEFECT STREAK | TRANSFER BELT CLEANER | STREAK PRESENT (MIXED COLORS) | ALL COLORS | STREAK PRESENT | STREAK PRESENT | NO IMPACT |

FIG. 15

IMAGE DIAGNOSIS

DIAGNOSIS RESULT: IMAGE QUALITY PROBLEM OCCURRED!
STREAK OCCURRED IN SUB SCANNING DIRECTION

CODE: ○○○○

REPLACEABLE UNIT: △△△△

OK

FIG. 18A

| | FIRST SHEET (CHART 301) | | | | | SECOND SHEET (CHART 302') | | | | THIRD SHEET (CHART 303') | | | |
|---|---|---|---|---|---|---|---|---|---|---|---|---|---|
| IMAGE PATTERN | W-P | D-P-Y | D-P-M | D-P-C | D-P-Bk | A1-P-Y | A1-P-M | A2-P-C | A2-P-Bk | A2-P-Y | A2-P-M | A1-P-C | A1-P-Bk |
| CAMOUFLAGE PATTERN | W-Ca | D-Ca-Y | D-Ca-M | D-Ca-C | D-Ca-Bk | A1-Ca-Y | A1-Ca-M | A2-Ca-C | A2-Ca-Bk | A2-Ca-Y | A2-Ca-M | A1-Ca-C | A1-Ca-Bk |
| CAMOUFLAGE PATTERN COLORS | Y, M, C, Bk, MIXED COLORS | Y, M, C, Bk, MIXED COLORS | Y, M, C, Bk, MIXED COLORS | Y, M, C, Bk, MIXED COLORS | Y, M, C, Bk, MIXED COLORS | M | Y | Y, M | Y, M | C, Bk | C, Bk | Bk | C |

FIG. 18B

| | FIRST SHEET (CHART 301) | | | | | SECOND SHEET (CHART 302') | | | | THIRD SHEET (CHART 303') | | | |
|---|---|---|---|---|---|---|---|---|---|---|---|---|---|
| IMAGE PATTERN | W-P | D-P-Y | D-P-M | D-P-C | D-P-Bk | A1-P-Y | A1-P-M | A1-P-C | A2-P-Bk | A2-P-Y | A2-P-M | A2-P-C | A1-P-Bk |
| CAMOUFLAGE PATTERN | W-Ca | D-Ca-Y | D-Ca-M | D-Ca-C | D-Ca-Bk | A1-Ca-Y | A1-Ca-M | A1-Ca-C | A2-Ca-Bk | A2-Ca-Y | A2-Ca-M | A2-Ca-C | A1-Ca-Bk |
| CAMOUFLAGE PATTERN COLORS | Y, M, C, Bk, MIXED COLORS | Y, M, C, Bk, MIXED COLORS | Y, M, C, Bk, MIXED COLORS | Y, M, C, Bk, MIXED COLORS | Y, M, C, Bk, MIXED COLORS | M, C | Y, C | Y, M | Y, M, C | Bk | Bk | Bk | NONE |

IMAGE FORMING APPARATUS FOR DETECTING FAULT LOCATION

BACKGROUND OF THE INVENTION

Field of the Invention

The present invention relates to fault determination processing for determining the location of a fault of an image forming apparatus.

Description of the Related Art

When an image forming apparatus such as a printer is subject to use that applies stress over a long time, there is a possibility of a "defective image", which is an image different from a normal one due to degradation or the like of parts, occurring. Because it is difficult to auto-detect by sensors a "defective image" that occurs due to degradation or the like, there are many cases where these are pointed out by a user, and attempts to resolve the cause are made. Furthermore, it is difficult to describe a "defective image" with words. For example, if detailed information such as the color, direction, and size of a streak is not known, it is not possible to identify the cause of the streak. Accordingly, it is necessary for a service person to whom a user pointed out the "defective image" to directly confirm an output image that includes the "defective image". The service person will estimate a faulty location in the image forming apparatus, and must first return to a service location bringing a unit that is to be replaced. When such an exchange is performed, a cost is incurred by the travel of the service person. Furthermore, the user cannot use the image forming apparatus until the cause is resolved. Accordingly, the user's productivity will greatly decrease.

A technique for controlling an image forming apparatus to form a pattern image of a predetermined density on a sheet, causing a reader device to read the pattern image, and identifying a unit that needs replacement based on read data of the pattern image is known (Japanese Patent Laid-Open No. 2017-83544). The method recited in Japanese Patent Laid-Open No. 2017-83544 analyzes the read data to obtain the density of the streak or the position of the streak in the pattern image, and decides the unit where the fault occurred based on an analysis result.

SUMMARY OF THE INVENTION

The present invention provides an image forming apparatus comprising a first image forming unit that forms a first image and includes a first photosensitive member, a first charging unit that charges the first photosensitive member, a first exposure unit that exposes the first photosensitive member to form an electrostatic latent image, and a first developing sleeve that develops the electrostatic latent image on the first photosensitive member by using a developing agent of a first color; a second image forming unit that forms a second image and includes a second photosensitive member, a second charging unit that charges the second photosensitive member, a second exposure unit that exposes the second photosensitive member to form an electrostatic latent image, and a second developing sleeve that develops the electrostatic latent image on the second photosensitive member by using a developing agent of a second color different from first color; a transfer portion at which the first image and the second image are transferred onto a sheet; a sensor that reads a test image formed on the sheet, the test image being used for detecting a causal part of a streak occurring when an image is formed on the sheet by the image forming apparatus; and a controller configured to control the first image forming unit and the second image forming unit to form a test image having a pattern. The test image is formed by the first image forming unit based on a first image forming condition in which an absolute value of a developing potential of the first developing sleeve is greater than an absolute value of a charging potential of the first photosensitive member. The pattern is formed by the second image forming unit based on a second image forming condition in which an absolute value of a developing potential of the second developing sleeve is less than an absolute value of a charging potential of the second photosensitive member. The controller is configured to control the sensor to read the test image having the pattern.

BRIEF DESCRIPTION OF THE DRAWINGS

FIG. 7 is a view for describing a relationship between types of streaks and replacement parts.

FIG. 15 is a view for describing an example of a message indicating a replacement part.

FIGS. 18A and 18B are tables for describing toner colors that can be used for camouflage patterns.

DESCRIPTION OF THE EMBODIMENTS

<First Embodiment>

[Image Forming Apparatus]

Figure 1:
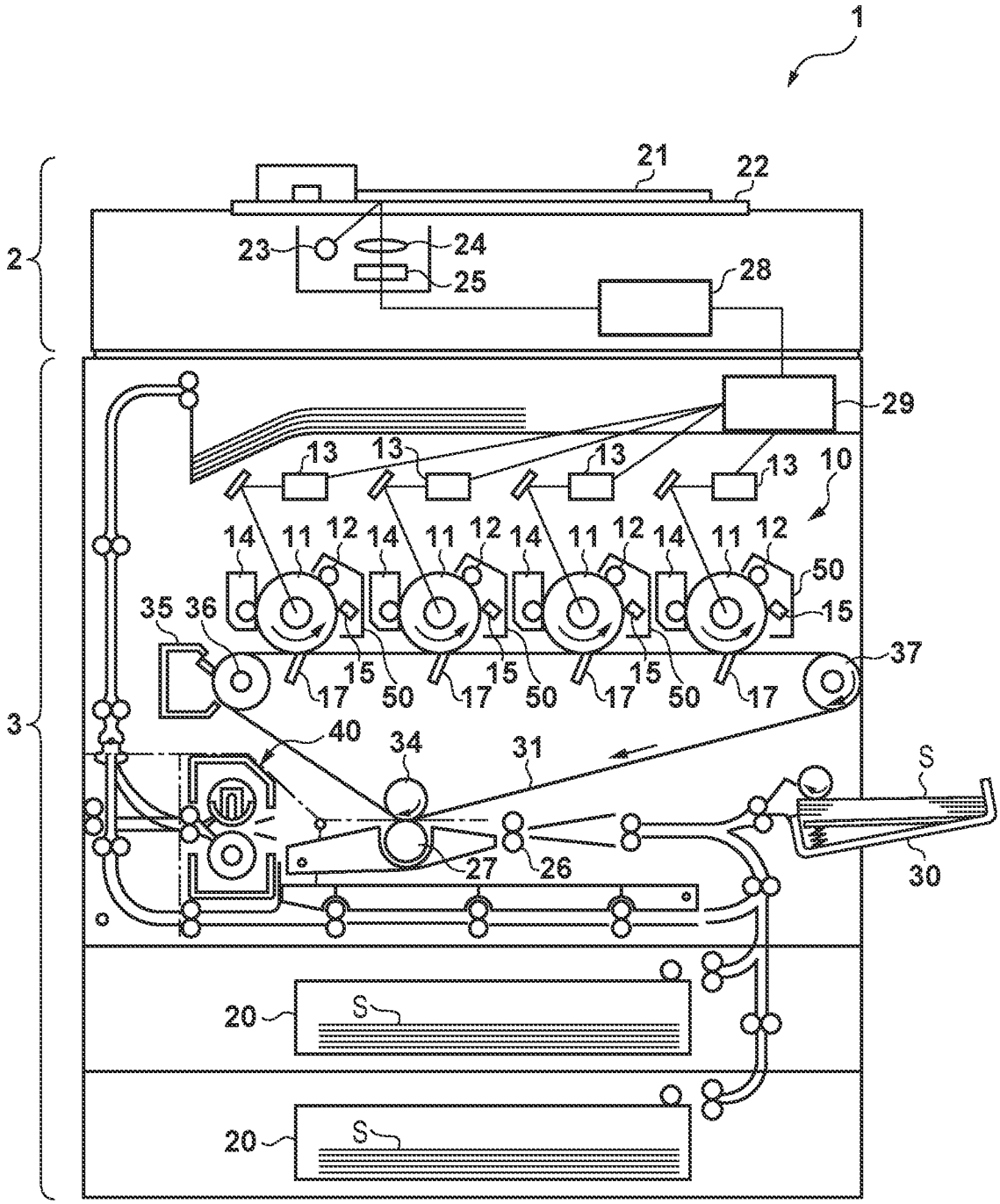
FIG. 1 is a view for describing an image forming apparatus.

FIG. 1 is an overview cross-sectional view of an image forming apparatus 1. The image forming apparatus 1 has an image reader 2 and a printer 3. The image reader 2 is a reader device for reading an original or a test chart. A light source 23 irradiates light on an original 21 placed on a platen glass 22. An optical system 24 guides a reflected light from the original 21 to a CCD sensor 25 causing an image to be formed. CCD is an abbreviation for charge-coupled device. The CCD sensor 25 generates color component signals for red, green, and blue. An image processing unit 28 executes image processing (example: shading correction or the like) on an image signal obtained by the CCD sensor 25, and outputs it to a printer controller 29 of the printer 3.

The printer 3 forms toner images on a sheet S based on the image data. The printer 3 has an image forming unit 10 for forming toner images of each color out of Y (yellow), M (magenta), C (cyan), and Bk (black). Note that the image forming unit 10 is provided with an image forming station for forming a yellow image, an image forming station for forming a magenta image, an image forming station for forming a cyan image, and an image forming station for forming a black image. In addition, the printer 3 of the present invention is not limited to a color printer for forming a full-color image, and may be a monochrome printer for forming a monochrome image, for example. As illustrated by FIG. 1, the four image forming stations corresponding to each color of Y, M, C, Bk are arranged in order from the left side of the image forming unit 10. The configurations of the four image forming stations are all the same, and thus the image forming station for forming a black image is described here. The image forming station is provided with a photosensitive drum 11. The photosensitive drum 11 functions as a photosensitive member. A charger unit 12, an exposure unit 13, a developing unit 14, a primary transfer unit 17, and a drum cleaner 15 are arranged around the photosensitive drum 11. The charger unit 12 is provided with a charging roller for charging the surface potential of the photosensitive drum 11 to a predetermined charging potential. The exposure unit 13 is provided with a light source, a mirror, and a lens. The developing unit 14 is provided with a housing for housing a developing agent (toner), and a developing roller for carrying the developing agent in the housing. A developing voltage is applied to the developing roller. The primary transfer unit 17 is provided with a transfer blade to which a transfer bias (primary) is supplied. Note that configuration may be such that the primary transfer unit 17 is provided with a transfer roller instead of a transfer blade. The drum cleaner 15 is provided with a cleaning blade for removing toner from the surface of the photosensitive drum 11.

Next, a process in which the black image forming station forms a toner image is described. Note that because processes in which image forming stations for colors other than black form toner images are similar processes, description thereof is omitted here. When image formation is started, the photosensitive drum 11 rotates in the arrow symbol direction. The charger unit 12 causes the surface of the photosensitive drum 11 to be charged uniformly. The exposure unit 13 exposes the surface of the photosensitive drum 11 based on image data outputted from the printer controller 29. Thereby, an electrostatic latent image is formed on the photosensitive drum 11. The developing unit 14 forms a toner image by developing by causing toner to adhere to the electrostatic latent image. The primary transfer unit 17 transfers the toner image carried on the photosensitive drum 11 to an intermediate transfer belt 31. The intermediate transfer belt 31 functions as an intermediate transfer member to which the toner image is transferred. The intermediate transfer belt 31 is turned by three rollers 34, 36, and 37. The drum cleaner 15 removes toner remaining on the photosensitive drum 11 that was not transferred to the intermediate transfer belt 31 by the primary transfer unit 17.

Sheets S are stacked on a feeding cassette 20 or a multi-feed tray 30. Feeding rollers feed a sheet S from the feeding cassette 20 or the multi-feed tray 30. A sheet S fed by the feeding roller is conveyed toward registration rollers 26 by conveyance rollers. The registration rollers 26 convey the sheet S to a transferring nip portion (transfer portion) between the intermediate transfer belt 31 and a secondary transfer unit 27 so that the toner image on the intermediate transfer belt 31 is transferred to a target position of the sheet S. The secondary transfer unit 27 is provided with a secondary transfer roller to which a (secondary) transfer bias is supplied. The secondary transfer unit 27 transfers the toner image on the intermediate transfer belt 31 to the sheet S at the transferring nip portion. A transfer cleaner 35 is provided with a cleaning blade for removing toner from the surface of the intermediate transfer belt 31. The transfer cleaner 35 removes toner remaining on the intermediate transfer belt 31 that was not transferred to the sheet S at the transferring nip portion. A fixing device 40 is provided with a heating roller having a heater and a pressure roller for pressing the sheet S to the heating roller. A fixing nip portion for fixing the toner image to the sheet S is formed between the heating roller and the pressure roller. The sheet S to which the toner image has been transferred passes through the fixing nip portion. The fixing device 40 uses the heat of the heating roller and the pressure of the fixing nip portion to fix the toner image to the sheet S.

[Replacement Part]

The photosensitive drum 11, the charger unit 12, and the drum cleaner 15 provided in the printer 3 of the present embodiment are integrated as one process cartridge 50. The process cartridge 50 can be attached/released with respect to the printer 3. As a result, a user or a service person can easily replace the photosensitive drum 11, the charger unit 12, and the drum cleaner 15. In addition, the developing unit 14 can also be attached/released with respect to the printer 3. Furthermore, the primary transfer unit 17 and the intermediate transfer belt 31 are integrated as a transfer cartridge. The transfer cartridge can also be attached/released with respect to the printer 3. A user or a service person can easily replace the primary transfer unit 17 and the intermediate transfer belt 31. Note that the transfer cleaner 35 may also be made capable of being attached/released with respect to the printer 3. Replacement parts of the present embodiment are the process cartridge 50, the developing unit 14 and a transfer cartridge.

[Control System]

Figure 2:
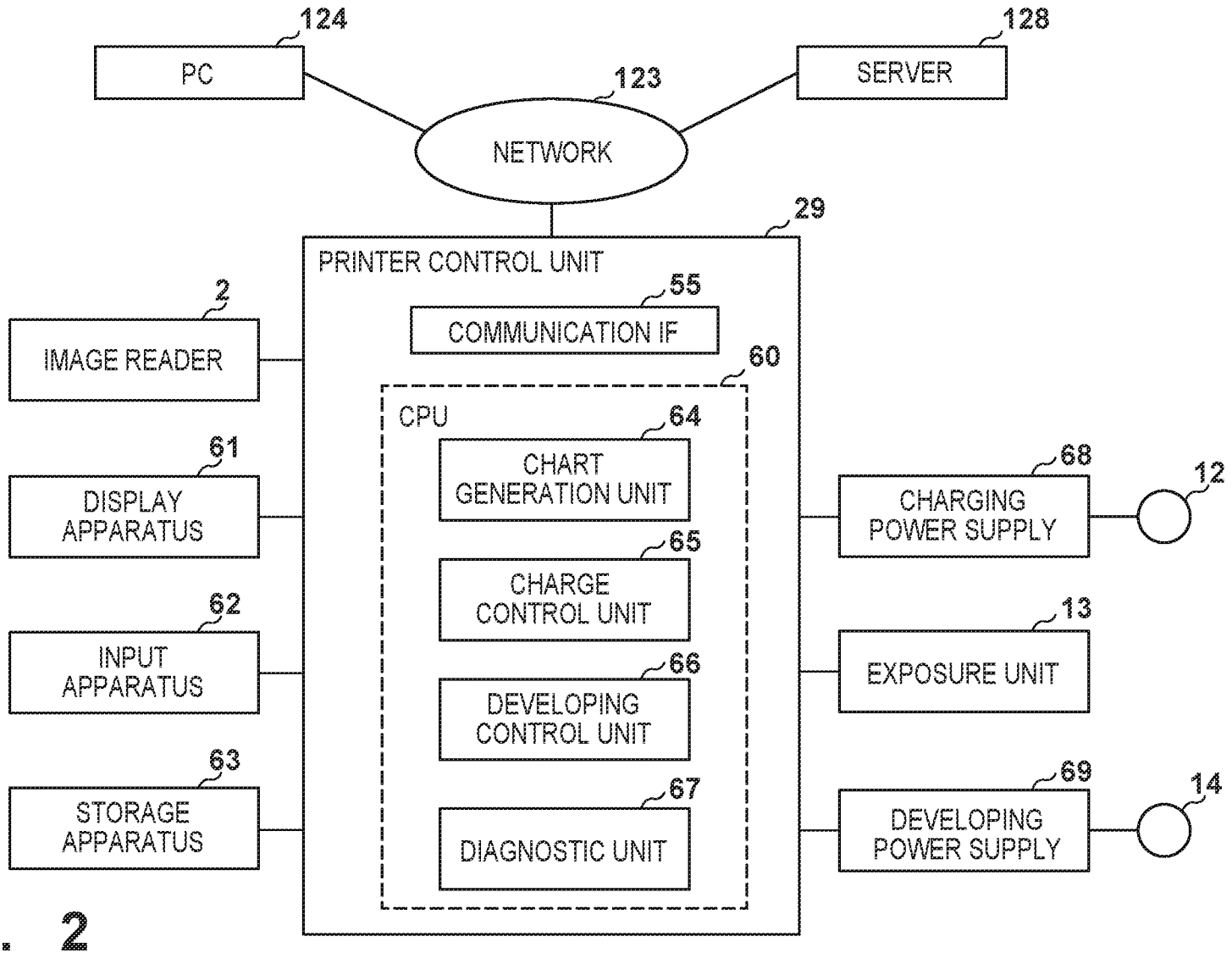
FIG. 2 is a view for describing a control system.

FIG. 2 illustrates a control system of the image forming apparatus 1. The image forming apparatus 1 can be connected via a network to an external device such as a PC 124 or a server 128, via a network 123. PC is an abbreviation for personal computer. The printer controller 29 controls the image reader 2 and the printer 3. The printer controller 29 may be separated into an image processing unit for executing image processing, and a device controller for controlling the image reader 2 and the printer 3. A communication IF 55 is a communication circuit for receiving image data transferred from an external device (the PC 124 or the server 128) connected via a network, or transmitting various pieces of data from the image forming apparatus 1 to an external device (the PC 124 or the server 128). A CPU 60 is a control circuit for comprehensively controlling each unit of the image forming apparatus 1. The CPU 60 realizes each kind of function by executing control programs stored in a storage apparatus 63. Note that some or all of the functions of the CPU 60 may be realized by hardware such as an ASIC, an FPGA or the like. ASIC is an abbreviation for application specific integrated circuit. FPGA is an abbreviation for field-programmable gate array. A display apparatus 61 is provided with a display for displaying various pieces of information such as a message, an image, or a moving image. An input apparatus 62 is provided with a numeric keypad, a start key, a stop key, and a read start button. The storage apparatus 63 is a memory such as a ROM or a RAM, and encompasses a bulk storage unit such as a hard disk drive. The CPU 60 performs image processing (data conversion processing, tone correction processing) on image data transferred from an external device or the image reader 2. The CPU 60 outputs the image data to which image processing has been performed to the exposure unit 13.

The CPU 60 realizes various functions, but a representative function related to the present embodiment is described here. A chart generation unit 64 controls the printer 3 to form a test image for identifying a replacement part on a sheet S. In the following description, a sheet S to which a test image is formed is referred to as a test chart or simply as a chart. Note that image data (pattern image data) for forming a test image is stored in the storage apparatus 63. A charging controller 65 controls a charging power supply 68 to apply a charging voltage to the charger unit 12. A developing controller 66 controls a developing power supply 69 to apply a developing voltage to the developing unit 14. A diagnostic unit 67 obtains a result of reading (read data) a chart read by the image reader 2, and determines a fault location based on the read data. Furthermore, the diagnostic unit 67 identifies a replacement part based on the determination result for the fault location.

[Chart]

When a replacement time period is reached for a process cartridge 50, a developing unit 14, or the like, a vertical streak occurs in an output image. A vertical streak is a straight line image that extends parallel to a conveyance direction of the sheet S. The diagnostic unit 67 analyzes read data of a test image outputted from the image reader 2, and identifies a replacement part based on the density of the streak or the position of the streak that occurred in the test image. A test chart of the present embodiment is described below.

The size of the test chart is assumed to be an A4 size (widthwise length 297 mm, conveyance-direction length 210 mm), for example. Note that the size of a test chart is not limited to the A4 size, and may be another size. In addition, the image forming apparatus 1 of the present embodiment outputs three test charts, for example, to determine a fault location (a causal part that causes a streak). However, the number of test charts may be one and may be a plurality of sheets, that is, two or more.

Figure 3:
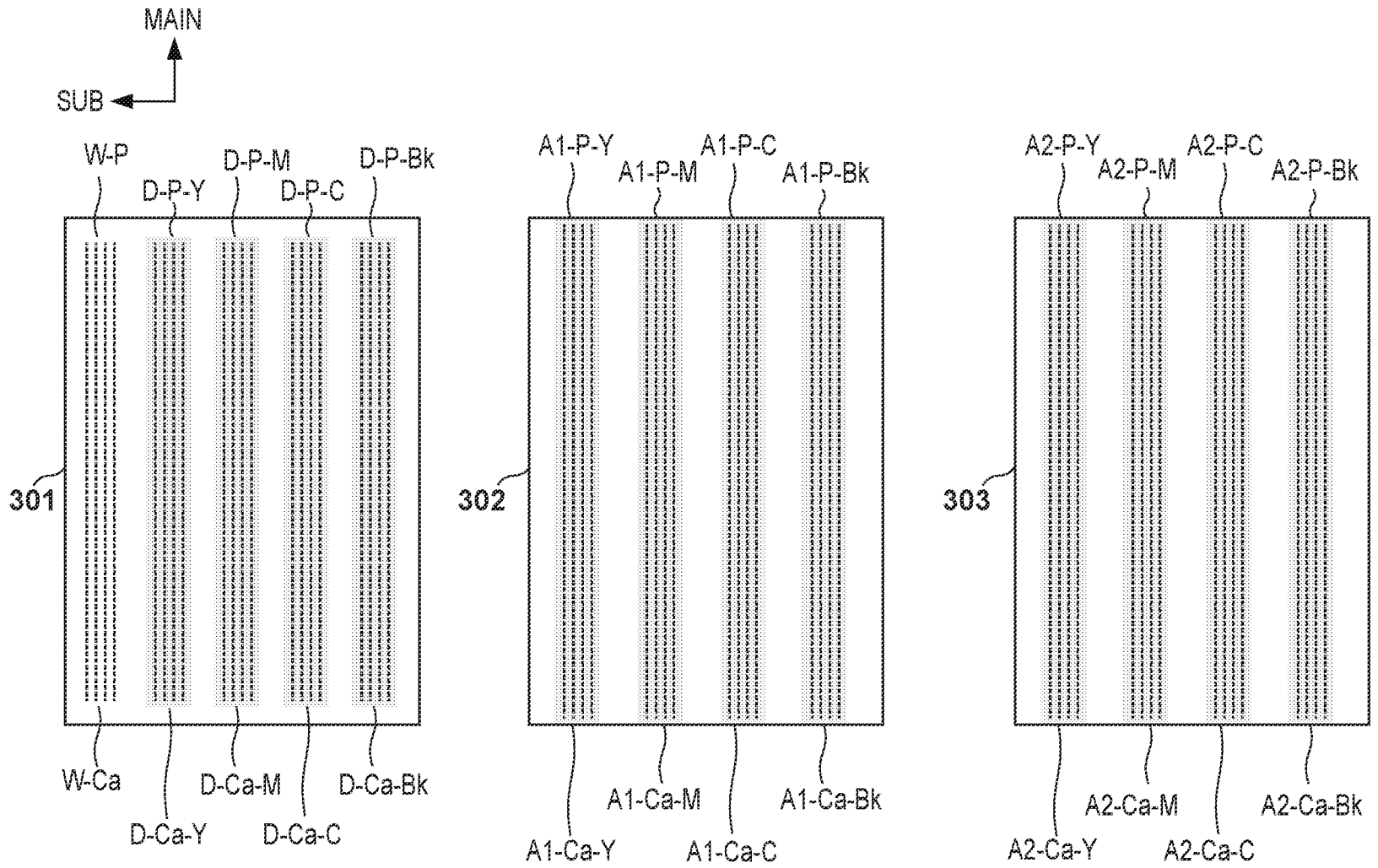
FIG. 3 is a view for describing a chart.

FIG. 3 is a schematic view of three charts 301, 302, and 303 printed by the printer 3. The charts 301, 302, and 303 have a plain region W-P, digital patterns D-P, and analog patterns A1-P and A2-P. In the following description, the digital patterns D-P and the analog patterns A1-P and A2-P are referred to as image patterns. In addition, in the following description the plain region W-P is referred to as a plain pattern. The color of toner used when forming each image pattern is a monochrome (a predetermined color), and is any one color of yellow, magenta, cyan, and black. As a result, it is possible to determine in which image forming station a fault location (a causal part that causes a streak) is present, from a result of reading an image pattern in which a streak image occurred.

The length of each image pattern in the conveyance direction of the test charts is 30 mm, for example. Note that the external diameter of a photosensitive drum 11 is 30 mm. An outer circumference of the photosensitive drum 11 is approximately 94.2 mm.

When the printer 3 forms the digital patterns D-P, the exposure unit 13 exposes the photosensitive drum 11. In other words, the digital patterns D-P are exposure images (toner images). The absolute value of the developing potential of the developing unit 14 is larger than the absolute value of the potential of an exposure region (a bright portion) in the photosensitive drum 11. Note that the absolute value of the developing potential of the developing unit 14 is smaller than the absolute value of the potential of an exposure region (a dark portion) in the photosensitive drum 11. The relationship of potentials described above is the same as the relationship of potentials in a case where the printer 3 copies an original, for example. In contrast, when the printer 3 forms the analog patterns A1-P and A2-P the exposure unit 13 does not expose the photosensitive drum 11. In other words, the analog patterns A1-P are non-exposure images (toner images). In order to cause toner to adhere to the photosensitive drum 11, the absolute value of the developing potential of the developing unit 14 is larger than the absolute value of the surface potential of the photosensitive drum 11. For example, in a case where the image forming apparatus, which develops an electrostatic latent image using toner that is charged to a negative polarity, forms an analog pattern A1-P, a developing potential of the developing unit 14 is controlled to a negative value. In such a case, the developing potential is lower than the surface potential of the photosensitive drum 11. For example, if the surface potential of the photosensitive drum 11 is greater than or equal to −100V and less than 0V, the developing potential is −300V.

Camouflage Pattern

Camouflage patterns are formed on image patterns and the plain pattern. A camouflage pattern is a pattern for obscuring an image defect that occurs on the test chart. In the present embodiment a camouflage pattern is formed on both of the image patterns and the plain pattern, but the present invention is not limited to this configuration. For example, a configuration in which a camouflage pattern is formed on image patterns and a camouflage pattern is not formed on plain patterns may be employed. In addition, the present invention is not limited to a configuration where a camouflage pattern is formed on all image patterns. For example, a configuration in which a camouflage pattern is not formed on an image pattern for yellow which it difficult to identify with visual observation, and a camouflage pattern is formed on image patterns of other colors (magenta, cyan, and black) may be employed. An image pattern on which a camouflage pattern is formed corresponds to a pattern image for detecting a fault location (a causal part where a streak occurs).

A camouflage pattern W-Ca is formed on the plain region W-P. Camouflage patterns A1-Ca are formed on the analog patterns A1-P. Camouflage patterns A2-Ca are formed on the analog patterns A2-P. Note that letters of Y, M, C, Bk added to the end of reference symbols indicating camouflage patterns indicate the color of the image pattern. An analog pattern A1-P-Y is formed by yellow toner. A camouflage pattern A1-Ca-Y indicates a camouflage pattern formed on an analog pattern A1-P-Y which is formed by yellow toner. Here, the camouflage pattern A1-Ca-Y is a blue (mixed color) camouflage pattern, for example. The camouflage pattern may be a pattern so that another image defect different from an image defect for identifying a replacement part is obscured.

A definition of camouflage is described here. Conventionally, a technique where text or an image hidden in a copy of an original appears in order to prevent forgery of the original is known. With this technique, text or an image that is difficult for a human eye to distinguish is formed on an original. The text or image that appears on a copy of the original corresponds to a camouflage pattern. In a macro sense, differences between a camouflage pattern and an image portion or differences between a camouflage pattern and a background portion where toner has not adhered are emphasized over differences between an image portion other than a camouflage pattern and a background portion. Accordingly, because the camouflage pattern will be relatively noticeable, the image portion or an outline of the image portion will be relatively obscured.

Figure 4:
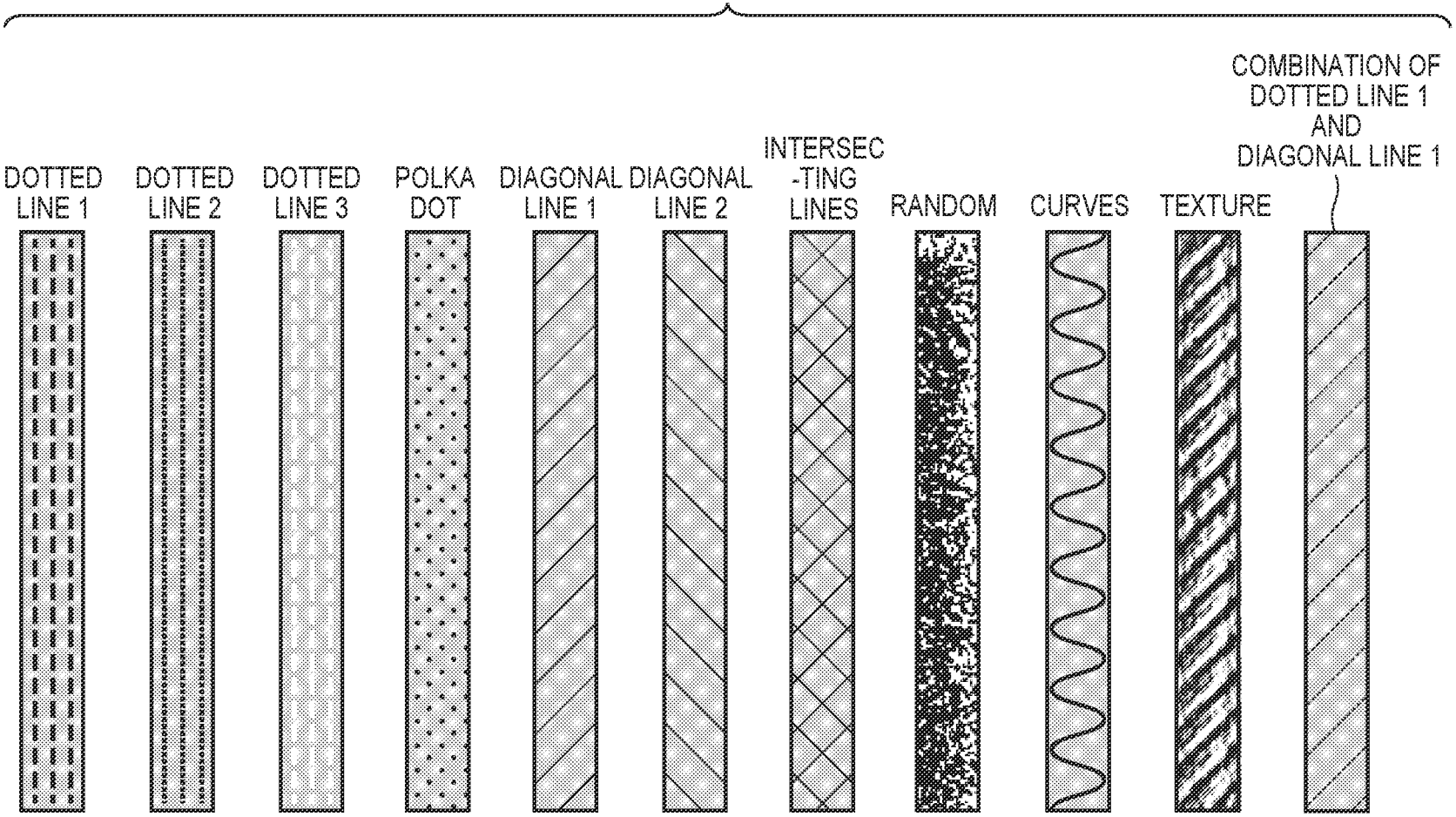
FIG. 4 is a view for describing a camouflage pattern.

FIG. 4 exemplifies various camouflage patterns added to image patterns. These are merely examples of camouflage patterns, and may be other patterns in the case of a pattern that obscures an image defect of an image pattern (a test image). Typically, an image pattern is formed based on a predetermined image signal value for all regions of the image pattern so that the density of the image pattern becomes a predetermined density. This is to cause an image defect to be apparent. A camouflage pattern is a specific pattern that is arranged regularly. For an image signal value for forming the specific pattern, an image signal value different from the predetermined image signal value is set, for example. As a result, the density of the specific pattern is different from the density of the image pattern (the predetermined density). In addition, the camouflage pattern is not limited to a regular specific pattern, and may be a random pattern.

A camouflage pattern may be any of dotted line 1, dotted line 2, dotted line 3, polka dots, diagonal line 1, diagonal line 2, or intersecting lines. In addition, a camouflage pattern may be a diagonal dotted line pattern that combines dotted line 1 and diagonal line 1, for example. As parameters for defining a camouflage pattern, there are line intervals, dot intervals, line thickness, line density, contrast between lines and image pattern, or the like. In addition, for a random pattern, a difference in density between the image pattern and the camouflage pattern and the shape of the pattern can be freely set. In addition, an image frequency of a random pattern can also be freely set.

A camouflage pattern is not limited to a geometric pattern. A camouflage pattern may be a pattern that causes a viewer to envision image such as marble or a blue sky, and is referred to as a texture pattern, for example. A texture pattern uses changes in a color difference, a brightness difference and a density difference between a high density region and a low density region to obscure an image defect of a chart.

Figure 5:
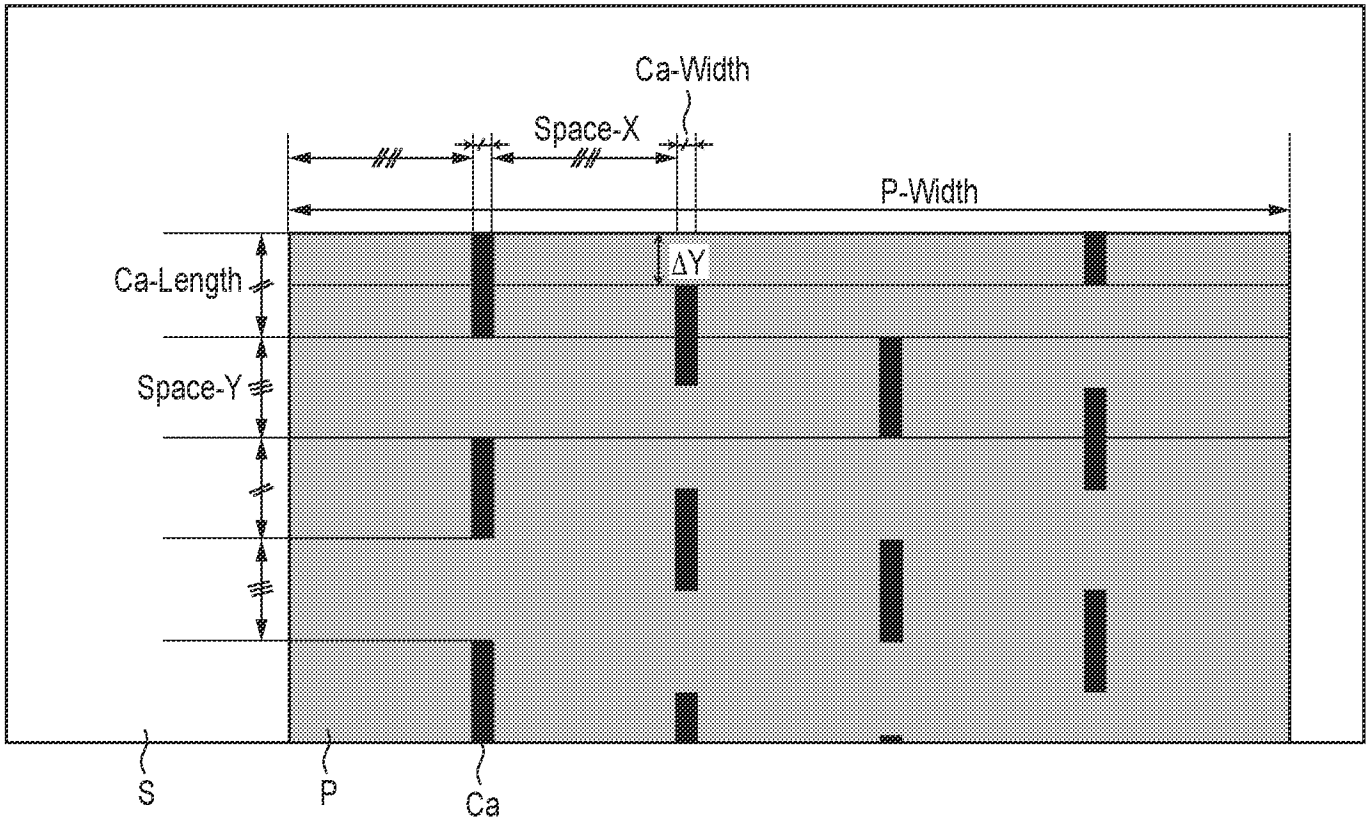
FIG. 5 is a view for describing a camouflage pattern.

FIG. 5 is an enlarged view of an image pattern on which a camouflage pattern is formed. In the image pattern illustrated in FIG. 5, a camouflage pattern Ca corresponding to dotted line 1 is formed with respect to an image pattern P. The width of the image pattern (P-Width) is 30 [mm]. The camouflage pattern Ca is configured from a plurality of rectangular patterns. A distance (Space-X) between two rectangular patterns adjacent in the X direction (a sub scanning direction) is 1.8 [mm]. A distance (Space-Y) between two rectangular patterns adjacent in the Y direction (a main scanning direction) is 0.7 [mm]. Note that the X direction (the sub scanning direction) is parallel to the conveyance direction of the sheet S, and is orthogonal to the Y direction (a main scanning direction). The width of the rectangular pattern (Ca-Width) is 0.25 [mm]. The length of the rectangular pattern (Ca-Length) is 0.7 [mm]. The width Ca-Width and the length Ca-Length may be 0.1 [mm] or more in order to make the camouflage pattern stand out visually. As the width Ca-Width and the length Ca-Length increase, a camouflage effect increases. However, when the camouflage effect increases, the area of a vertical streak detection region decreases. For this reason, the width Ca-Width and the length Ca-Length of the rectangular pattern are decided so that it is possible to detect a vertical streak from read data of a test image on which rectangular patterns are formed. From experimentation, it is possible to detect a vertical streak from read data if the width Ca-Width and the length Ca-Length were less than or equal to 5.0 [mm].

A vertical streak is an image defect for identifying a replacement part. As illustrated in FIG. 5, two rectangular patterns adjacent in the X direction are shifted by a predetermined amount ΔY in the Y direction. ΔY is 0.3 [mm], for example. A longer side direction of the rectangular pattern is orthogonal with the X direction (the sub scanning direction). In other words, the longer side direction of the rectangular pattern and the longer side direction of a vertical streak differ. This is to suppress an increase of the camouflage effect, and a decrease of the area of a vertical streak detection region. The distance Space-X between rectangular patterns in the X direction and the distance Space-Y between rectangular patterns in the Y direction are decided to be distances having high sensitivity with respect to vision characteristics of a human. However, as the distance Space-X and the distance Space-Y shorten, the area of a vertical streak detection region decreases. For this reason, the distances Space-X and Space-Y are decided so that it is possible to detect a vertical streak from read data of a chart on which rectangular patterns are formed.

The color of the camouflage pattern Ca is set so that a color difference ΔE00 in visual observation is 3.0 or more with respect to a digital pattern D-P or analog patterns A1-P and A2-P. As the color difference ΔE00 increases, the camouflage effect also increases.

Digital Patterns

Figure 6A:
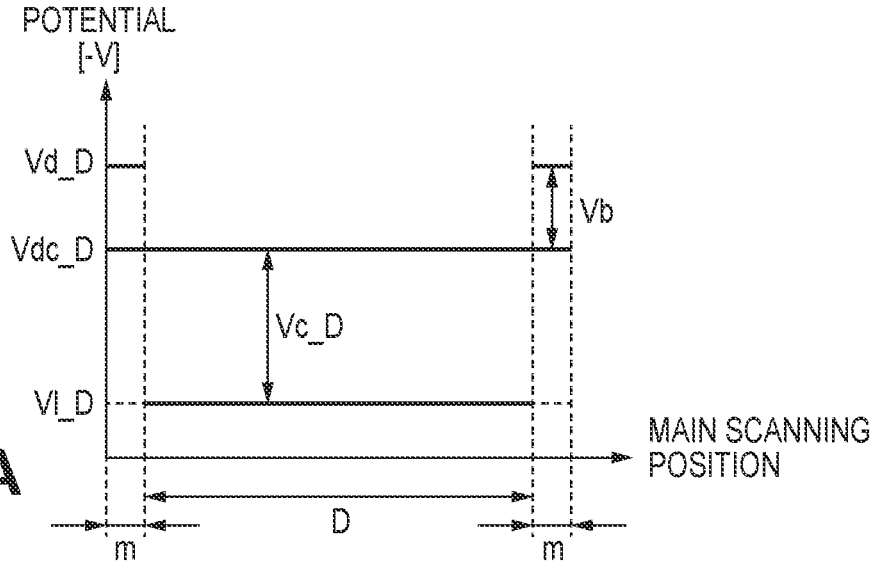
FIGS. 6A to 6F are views for describing a relationship among latent image potential, charging potential, and developing potential.
Figure 6B:
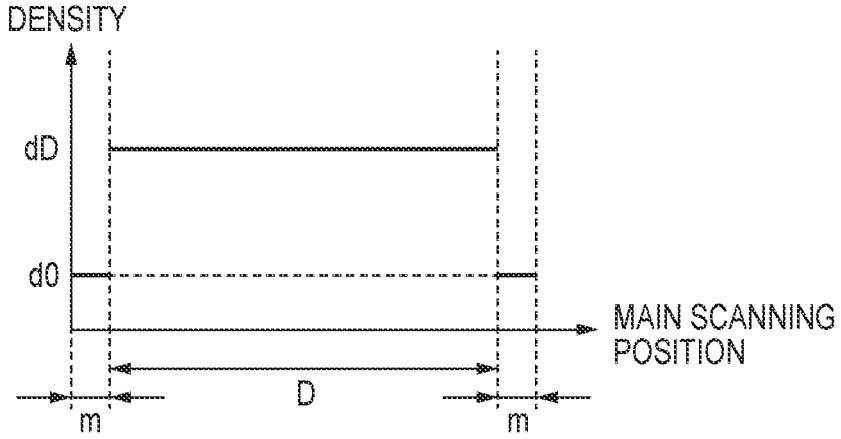

FIG. 6A illustrates the potential of each position in the Y direction on the photosensitive drum 11 in a case where the printer 3 forms a digital pattern D-P. In FIG. 6A, the potential of a position where the camouflage pattern D-Ca of the photosensitive drum 11 is formed is omitted. FIG. 6B illustrates a density dD of the digital pattern D-P formed on the sheet S, and a density d0 of a plain region W-P. The density d0 is the optical density of the sheet S.

The charging controller 65 controls the charging power supply 68 so that the surface potential of the photosensitive drum 11, which is charged by the charger unit 12, becomes a potential Vd_D. The exposure unit 13 exposes the photosensitive drum 11 based on the pattern image data. As a result, the potential of the exposure region of the photosensitive drum 11 (a light portion potential) changes to V1_D. Note that the potential of a non-exposure region of the photosensitive drum 11 (a dark portion potential) is maintained at Vd_D. The developing controller 66 controls the developing power supply 69 so that the potential of the developing sleeve of the developing unit 14 becomes a developing potential Vdc_D which is a developing bias. The developing potential Vdc_D is set between a dark portion potential Vd_D and the light portion potential V1_D. A potential difference Vb corresponds to a potential difference between the developing potential Vdc_D and the dark portion potential Vd_D. As a result, toner does not adhere to a margin region. An image signal value of the pattern image data is decided in advance so that the optical density dD of the digital pattern D becomes 0.6, for example. The optical density dD of the digital pattern D-P may be any density if it is a density where a vertical streak is easy to detect. An image signal value of a digital pattern D-P is 50%, for example.

Analog Pattern

Figure 6C:
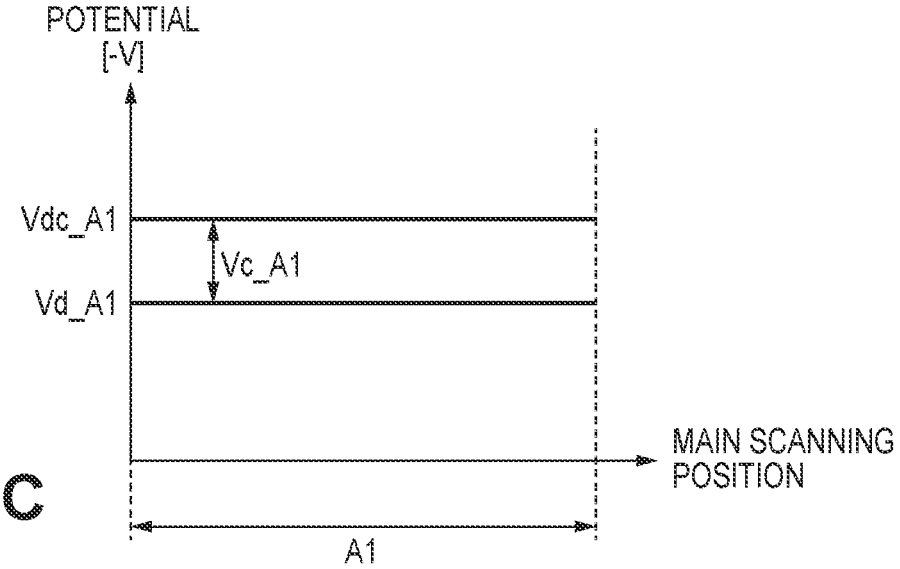
Figure 6D:
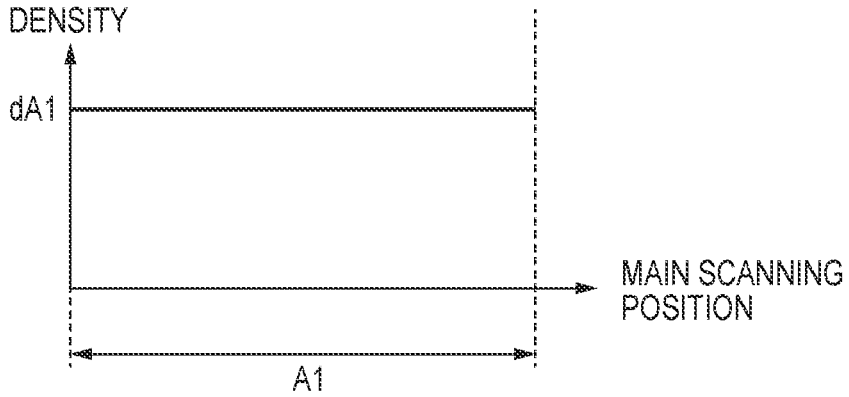

FIG. 6C illustrates the potential of each position in the Y direction on the photosensitive drum 11 in a case where the printer 3 forms a first analog pattern A1-P. In FIG. 6C, the potential of a position where the camouflage pattern Ca of the photosensitive drum 11 is formed is omitted. FIG. 6D illustrates a density dA1 of an analog pattern A1-P formed on the sheet S.

The charging controller 65 controls the charging power supply 68 so that the surface potential of the photosensitive drum 11, which is charged by the charger unit 12, becomes a potential Vd_A1. The developing controller 66 controls the developing power supply 69 so that the potential of the developing sleeve of the developing unit 14 becomes a developing potential Vdc_A1. An absolute value of the developing potential Vdc_A1 is larger than an absolute value of a charging potential Vd_A1. Note that, when an analog pattern A1-P is formed, the exposure unit 13 does not irradiate a laser beam onto the photosensitive drum 11. As illustrated by FIG. 6C, a potential difference Vc_A1 (a development contrast Vc_A1) arises between the photosensitive drum 11 and the developing sleeve. By this, the analog pattern A1-P is formed on the photosensitive drum 11. Note that margins are not formed on both sides of the analog pattern A1-P. In addition, because the photosensitive drum 11 is not exposed, the density of the analog pattern A1-P is decided based on the development contrast Vc_A1. An optical density dA1 of the analog pattern A1 is 0.6, for example. The CPU 60 controls the developing controller 66 and the developing power supply 69 to adjust the development contrast Vc_A1. As illustrated by FIG. 6D, an analog pattern A1 of the optical density dA1 (=0.6) is formed on the sheet S.

Figure 6E:
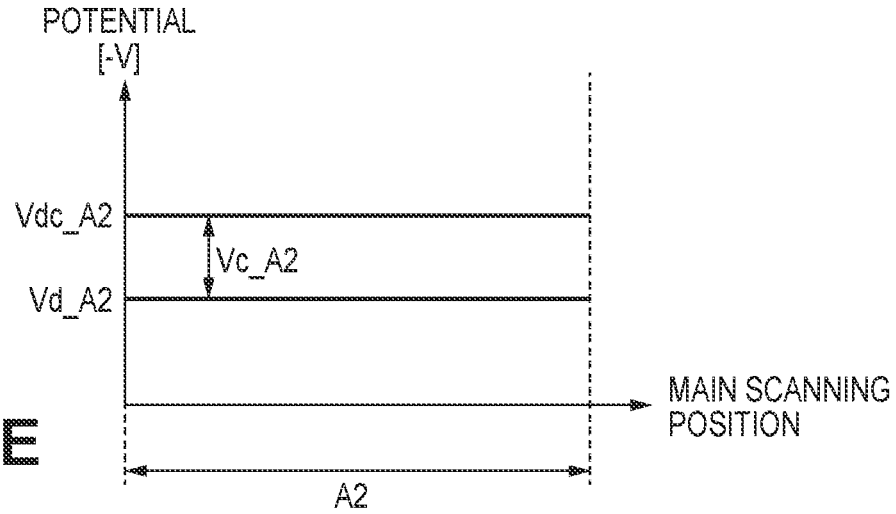

FIG. 6E illustrates the potential of each position in the Y direction on the photosensitive drum 11 in a case where the printer 3 forms a second analog pattern A2-P. In FIG. 6E, the potential of a position where the camouflage pattern Ca of the photosensitive drum 11 is formed is omitted.

Figure 6F:
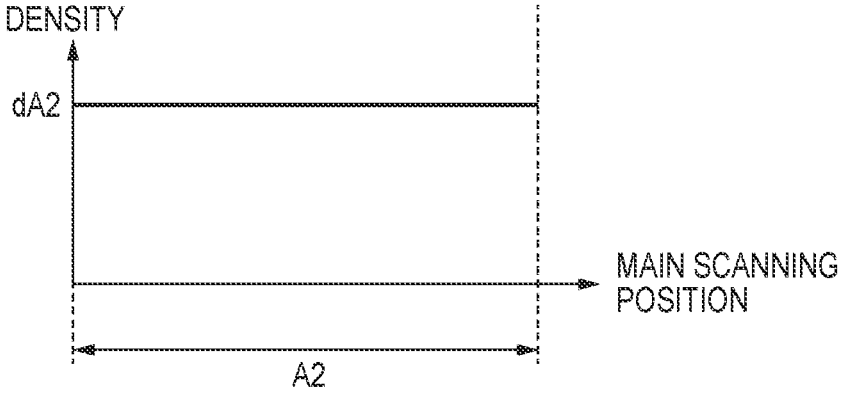

FIG. 6F illustrates a density dl of an analog pattern A2 formed on the sheet S. The charging controller 65 controls the charging power supply 68 so that the potential of the surface of the photosensitive drum 11 becomes a charging potential Vd_A2. The developing controller 66 controls the developing power supply 69 so that the potential of the developing sleeve of the developing unit 14 becomes a developing potential Vdc_A2. An absolute value of the developing potential Vdc_A2 is larger than an absolute value of the charging potential Vd_A2. Note that, when an analog pattern A2-P is formed, the exposure unit 13 does not irradiate a laser beam. As illustrated by FIG. 6F, a development contrast Vc_A2 arises between the photosensitive drum 11 and the developing sleeve. By this, the analog pattern A2-P is formed on the photosensitive drum 11. Margins are not formed on both sides of the analog pattern A2-P. In addition, because exposure of the photosensitive drum 11 is not applied, the density of the analog pattern A2-P is decided based on the development contrast Vc_A2. An optical density dA2 of the analog pattern A1 is 0.6, for example. The CPU 60 controls the developing controller 66 and the developing power supply 69 to adjust the development contrast Vc_A2. As illustrated by FIG. 6F, an analog pattern A2 of the optical density dA2 (=0.6) is formed on the sheet S.

Here, the second charging potential Vd_A2 for forming the analog pattern A2-P is set lower than the charging potential Vd_A1 for forming the analog pattern A1-P (|Vd_A1|>|Vd_A2|). As a result, a contribution rate of the charger unit 12 with respect to an image defect decreases for the analog pattern A2-P in comparison to the analog pattern A1-P. This is because the diagnostic unit 67 compares streaks occurring with the analog pattern A1-P and the analog pattern A2-P to determine whether the cause of a streak is the charger unit 12 or the developing unit 14. In addition the development contrast Vc_A1 of an analog pattern A1 and the development contrast Vc_A2 of an analog pattern A2 are the same. Accordingly, the optical density of the analog pattern A1-P and the optical density of the analog pattern A2-P are the same. However, the development contrast Vc_A1 of an analog pattern A1 and the development contrast Vc_A2 of an analog pattern A2 may differ.

For the above description, image forming conditions are controlled so that the optical density dD of the digital pattern D-P, the optical density dA1 of the analog pattern A1-P, and the optical density dA2 of the analog pattern A2-P become a predetermined density. However, the optical density dD of the digital pattern D-P, the optical density dA1 of the analog pattern A1-P, and the optical density dA2 of the analog pattern A2-P may each be different densities. However, in this case the density of a streak that occurs for each image pattern differs. In a case of having this configuration, the diagnostic unit 67 corrects the density of the streak occurring in each image pattern to determine a fault location (the causal part that generated the streak).

[Vertical Streak]

Using FIG. 7, vertical streaks that occur in a chart of the present embodiment are described. FIG. 7 indicates vertical streak types, a replacement part or response method, a state of a plain portion, the color of the pattern where a streak occurs, the existence or absence of the occurrence of a streak for each of a digital pattern and an analog pattern, and an impact of reducing a charging potential for an analog pattern. Note that a streak whose optical density is thinner than a predetermined density (0.6) is referred to as a white streak, and a streak whose optical density is thicker than the predetermined density (0.6) is referred to as a black streak.

A Streak Caused by a Developing Coat Defect

Figure 8A:
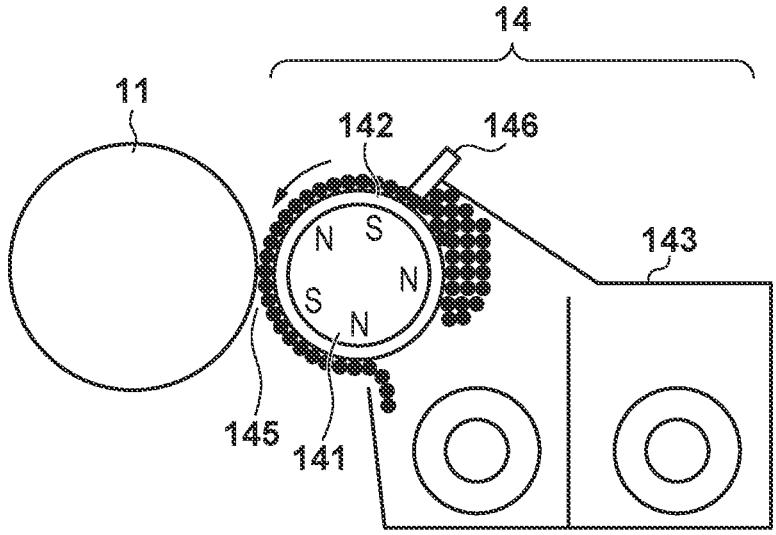
FIGS. 8A to 8C are views for describing a defect of a developing coat.
Figure 8B:
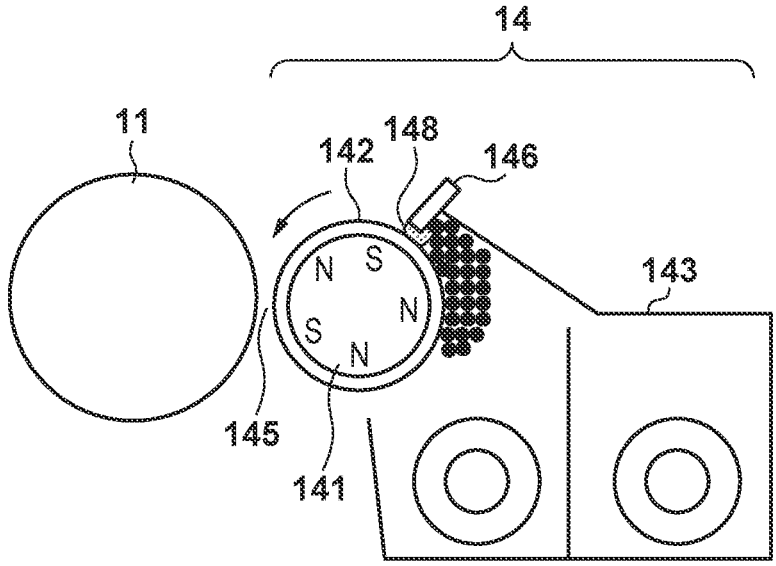

A developing coat defect streak indicated in FIG. 7 is a vertical streak that occurs because a developing coat is insufficient. FIG. 8A and FIG. 8B are views for describing a cause for a streak occurring due to a developing coat defect. The developing coat means that a developing agent is caused to adhere to the surface of a developing sleeve 142 at a uniform thickness. A magnet 141 functioning as a developing agent carrier is provided inside the developing sleeve 142. The developing sleeve 142 is supported by a developing container 143 to be able to rotate freely. A closest part 145 is a part at which the distance between the developing sleeve 142 and the photosensitive drum 11 is the closest. In the rotation direction of the developing sleeve 142, a regulation blade 146 is provided upstream of the closest part 145. The regulation blade 146 is arranged so that the distance in relation to the developing sleeve 142 is fixed, and regulates the amount of two-component developing agent supplied to the closest part 145.

Figure 8C:
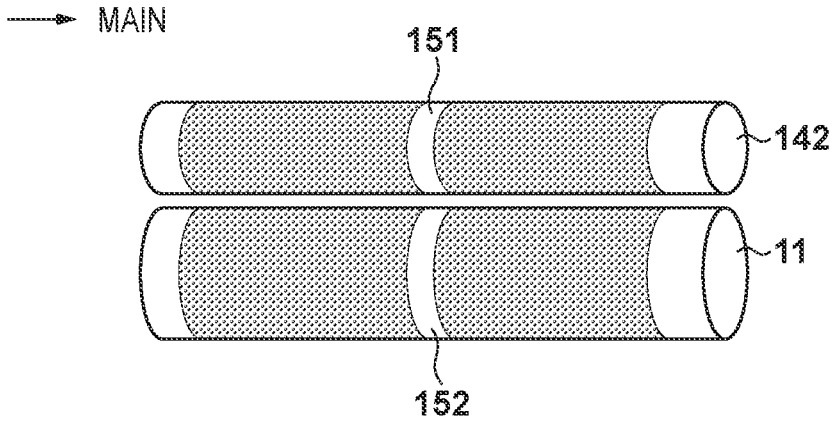

As illustrated by FIG. 8B, a foreign particle 148 such as dust or a hair may be clogged between the developing sleeve 142 and the regulation blade 146. In such a case, the foreign particle 148 impedes flow of the developing agent. As illustrated by FIG. 8C, a vertical streak 151 where developing agent is not carried occurs on the developing sleeve 142. The developing agent is not supplied to the part facing the vertical streak 151 in the surface of the photosensitive drum 11 because there is no developing agent in the vertical streak 151. Therefore, a vertical streak 152 is such that a straight line which continues on the surface of the photosensitive drum 11 occurs. As indicated by FIG. 7, the unit to replace in order to resolve such a developing coat defect streak is the developing unit 14.

Furthermore, characteristics of a white streak that occurs due to a developing coat defect are described using FIG. 7. Firstly, a streak does not occur in a plain region W-P where an image pattern is not formed. Also, a color for which a streak occurs is only the color of the developing unit for which the developing coat defect occurred.

Figure 9A:
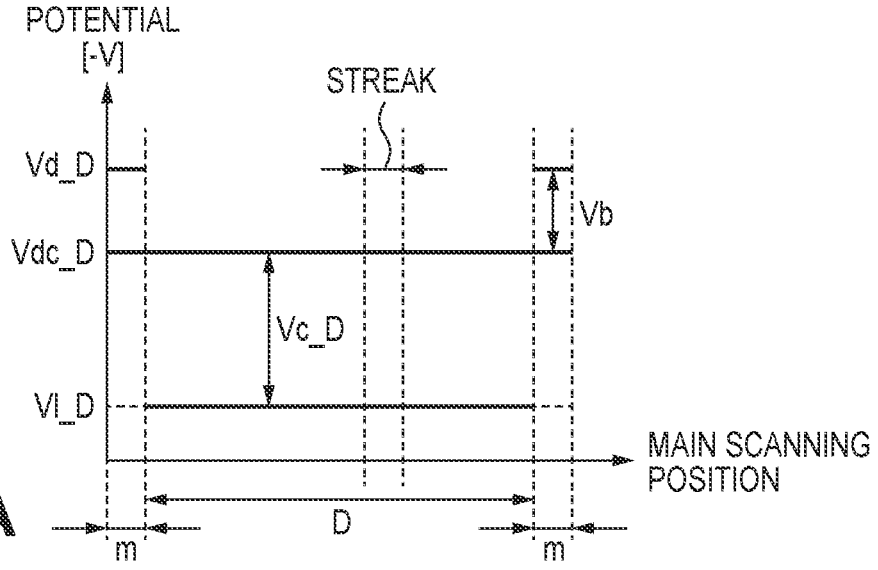
FIGS. 9A to 9F are views for describing a relationship among streaks, latent image potential, charging potential, and developing potential.
Figure 9B:
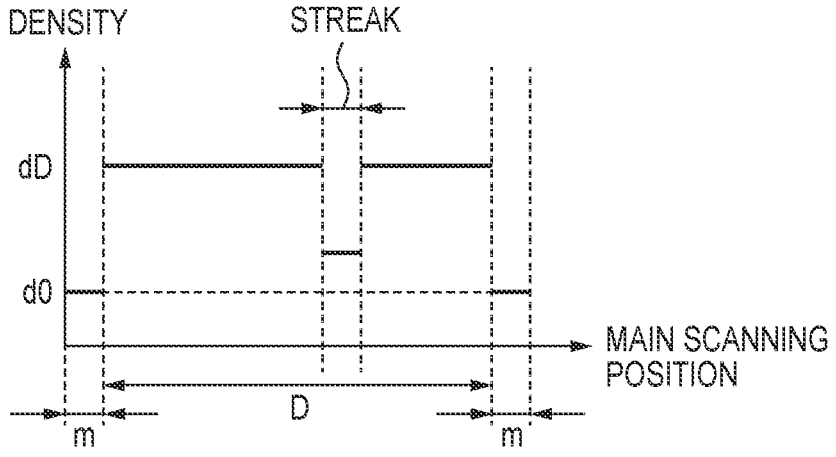
Figure 9C:
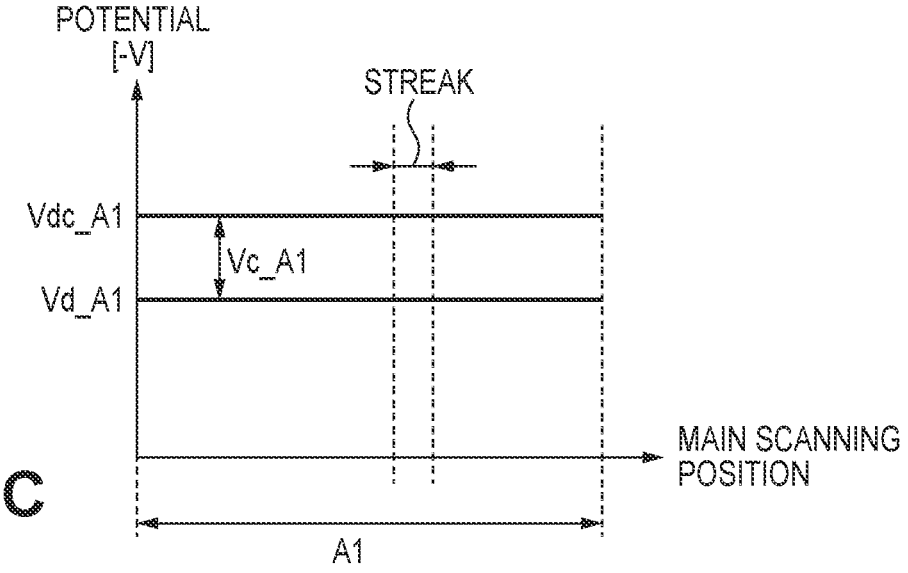
Figure 9D:
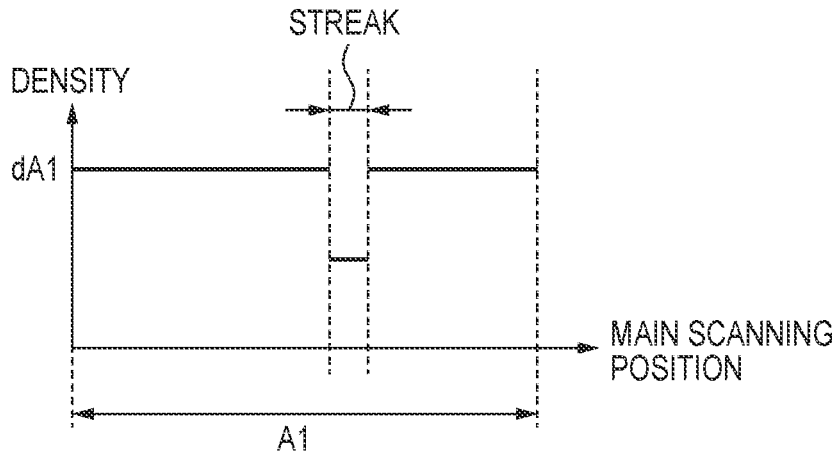
Figure 9E:
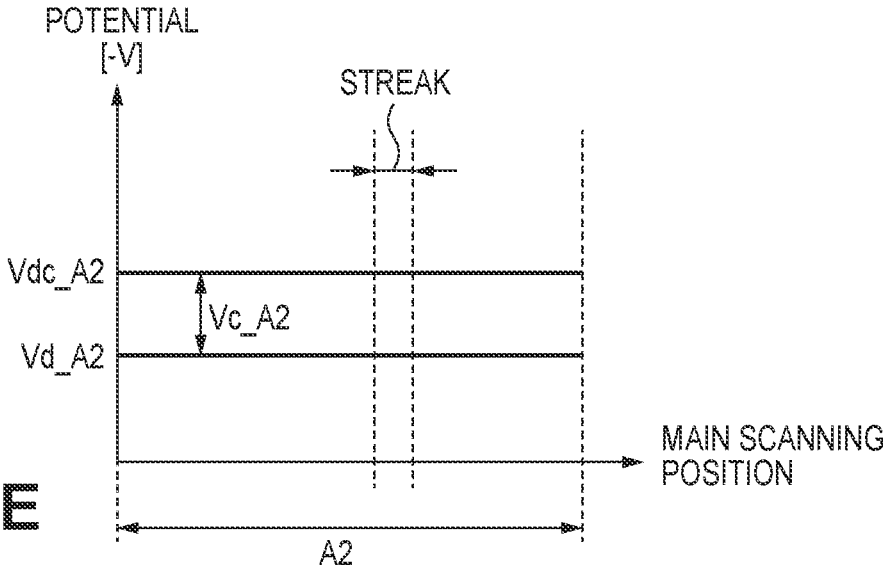
Figure 9F:
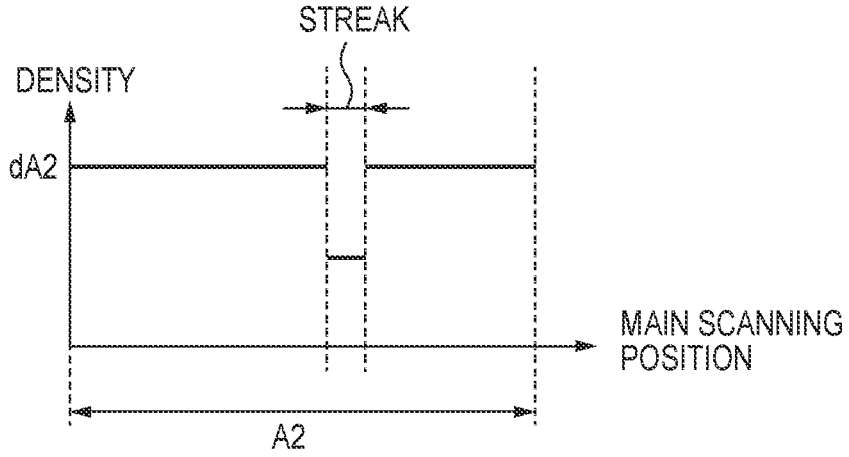

FIG. 9A illustrates potentials at each main scanning position of the photosensitive drum 11 when a digital pattern D-P is formed. FIG. 9B illustrates optical density at each main scanning position of a sheet S when the digital pattern D is formed. FIG. 9C illustrates potentials at each main scanning position of the photosensitive drum 11 when an analog pattern A1-P is formed. FIG. 9D illustrates optical density at each main scanning position of a sheet S when an analog pattern A1-P is formed. FIG. 9E illustrates potentials at each main scanning position of the photosensitive drum 11 when an analog pattern A2-P is formed. FIG. 9F illustrates optical density at each main scanning position of a sheet S when an analog pattern A2-P is formed. As these illustrate, a developing coat defect streak is due to developing agent not being supplied on the developing sleeve 142. Accordingly, a vertical streak occurs for all of the digital patterns D-P, and the analog patterns A1-P and A2-P. Furthermore, there is no difference between the density of a streak that occurs in the analog pattern A1-P, and the density of a streak that occurs in the analog pattern A2-P.

Streak Caused by an Exposure Defect

Figure 10A:
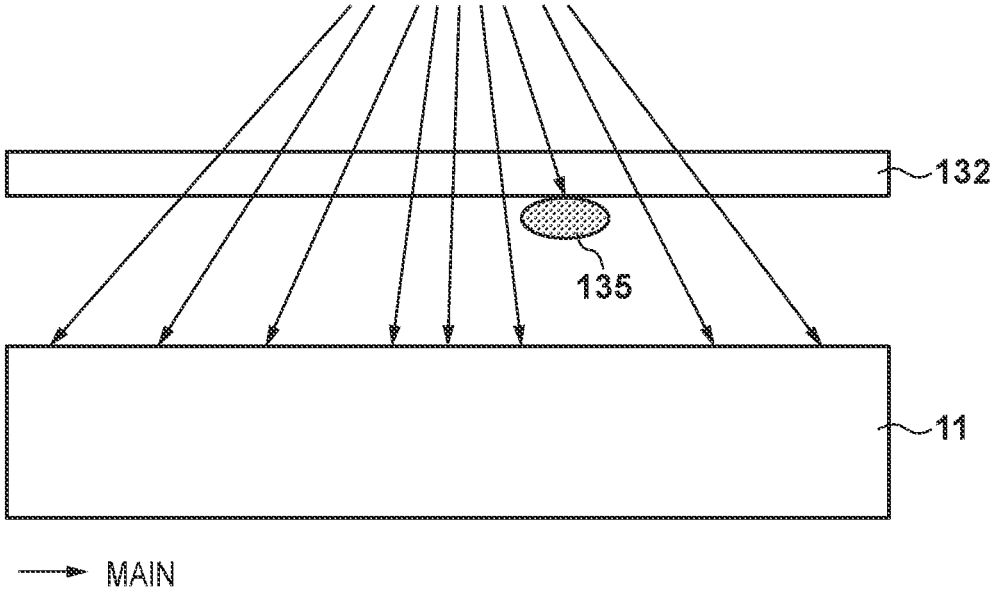
FIGS. 10A and 10B are views for describing an exposure defect and a plasticity deformation.

Next, a white streak due to an exposure defect indicated by FIG. 7 is described. FIG. 10A is a view for describing a mechanism where a white streak due to an exposure defect occurs. A dustproof glass 132 is provided in a light path along which a laser beam outputted from the exposure unit 13 passes. When a foreign particle 135 such as a hair or toner adheres to a portion of the dustproof glass 132, a laser beam irradiated onto the surface of the photosensitive drum 11 is blocked. That is, a vertical streak occurs when the potential of the electrostatic latent image of a part at which the laser beam is not irradiated due to the foreign particle 135 on the surface of the photosensitive drum 11 decreasing. This vertical streak becomes a white streak because it occurs due to the amount of adhered toner decreasing. The response method for reducing a white streak caused by an exposure defect is to perform cleaning work on the dustproof glass 132, or to replace the exposure unit 13.

Characteristics of a white streak due to an exposure defect are described using FIG. 7. Firstly, a streak does not occur in a plain region W-P where an image pattern is not formed. The color where a streak occurs in the digital pattern D-P is the color the exposure unit 13 that caused an exposure defect is responsible for.

Figure 11A:
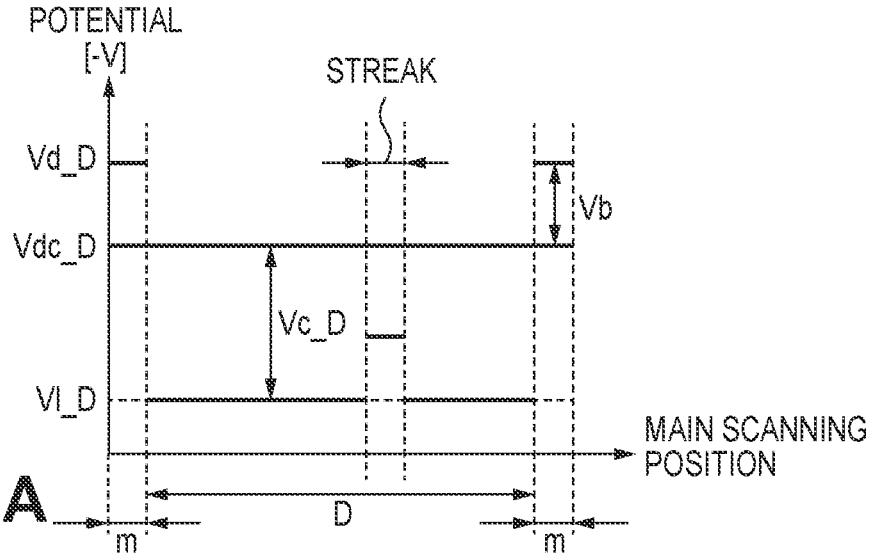
FIGS. 11A to 11F are views for describing a relationship among streaks, latent image potential, charging potential, and developing potential.
Figure 11B:
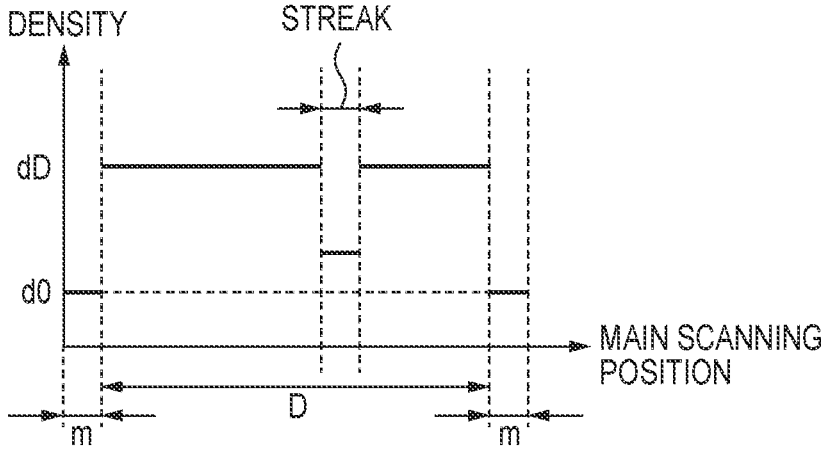
Figure 11C:
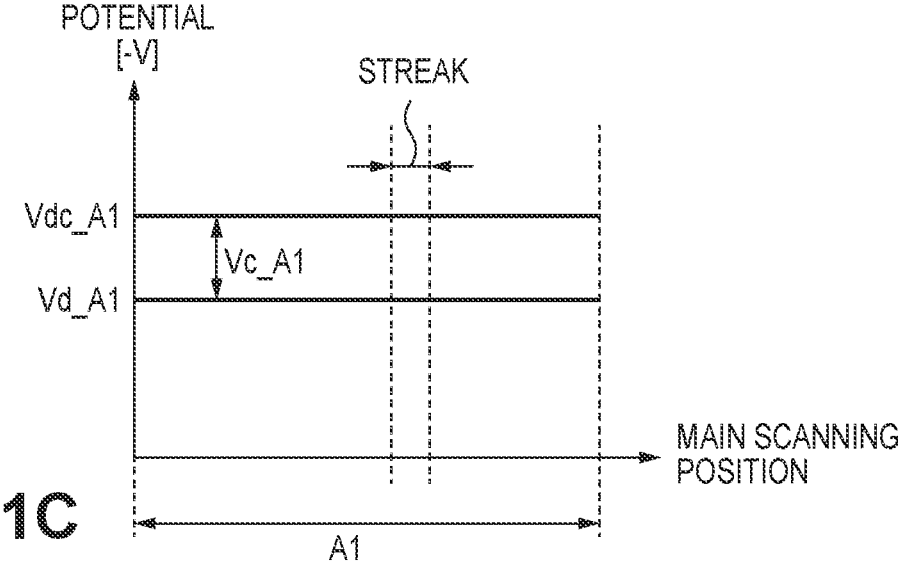
Figure 11D:
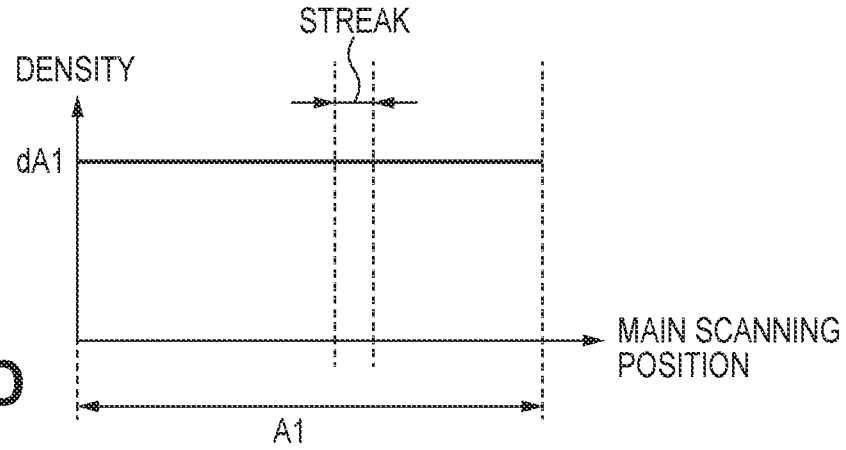
Figure 11E:
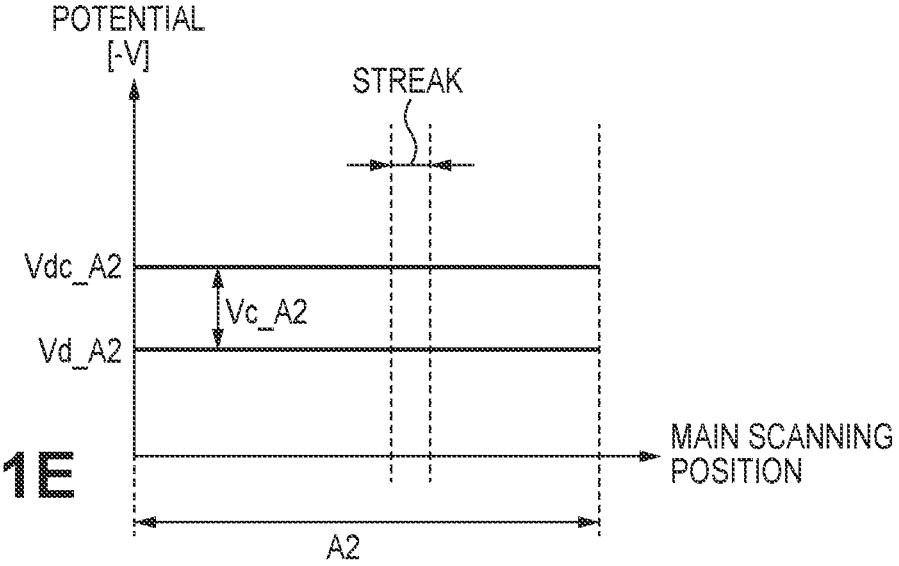
Figure 11F:
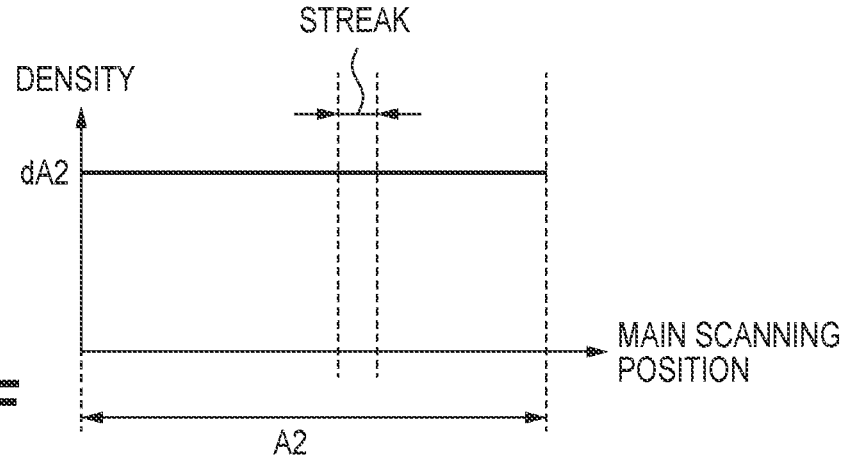

FIG. 11A illustrates potentials at each main scanning position of the photosensitive drum 11 when a digital pattern D-P is formed. FIG. 11B illustrates optical density at each main scanning position of a sheet S when the digital pattern D-P is formed. FIG. 11C illustrates potentials at each main scanning position of the photosensitive drum 11 when an analog pattern A1-P is formed. FIG. 11D illustrates optical density at each main scanning position of a sheet S when an analog pattern A1-P is formed. FIG. 11E illustrates potentials at each main scanning position of the photosensitive drum 11 when an analog pattern A2-P is formed. FIG. 11F illustrates optical density at each main scanning position of a sheet S when an analog pattern A2-P is formed.

As illustrated by FIG. 11A or FIG. 11B, a white streak occurs due to an exposure defect (an amount of exposure light getting smaller). Accordingly, in the digital pattern D-P, a white streak occurs by a surface potential at a portion of main scanning positions of the photosensitive drum 11 getting higher than V1_D. In contrast, as illustrated by FIG. 11C through FIG. 11F, a streak does not occur for the analog patterns A1-P and A2-P because the analog patterns A1-P and A2-P are formed without applying exposure.

Streak Caused by a Charge Defect

Figure 12A:
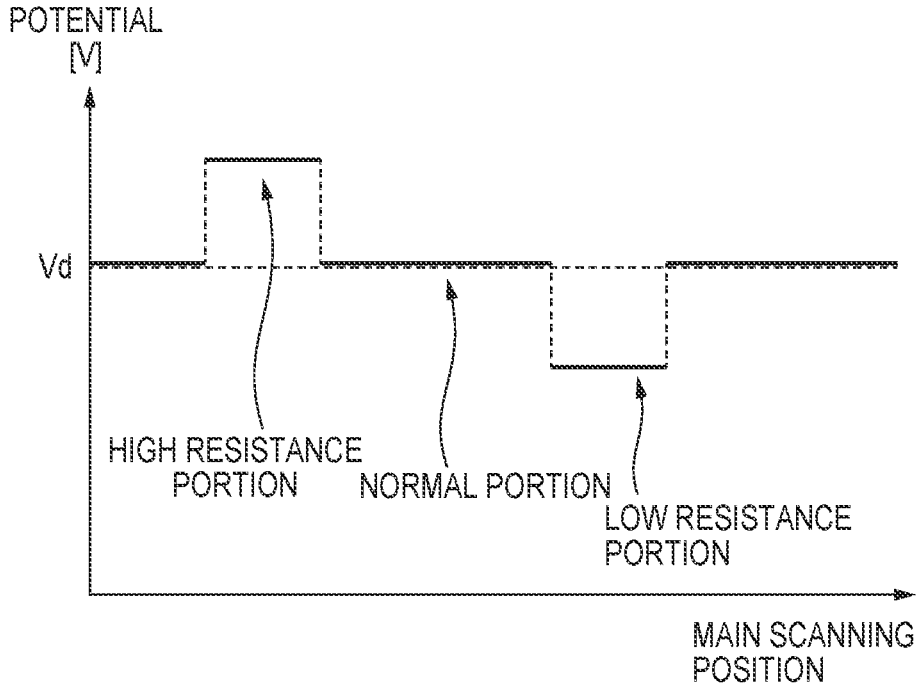
FIGS. 12A to 12B are views for describing a relationship between a streak and a cleaning defect of a photosensitive drum.
Figure 12B:
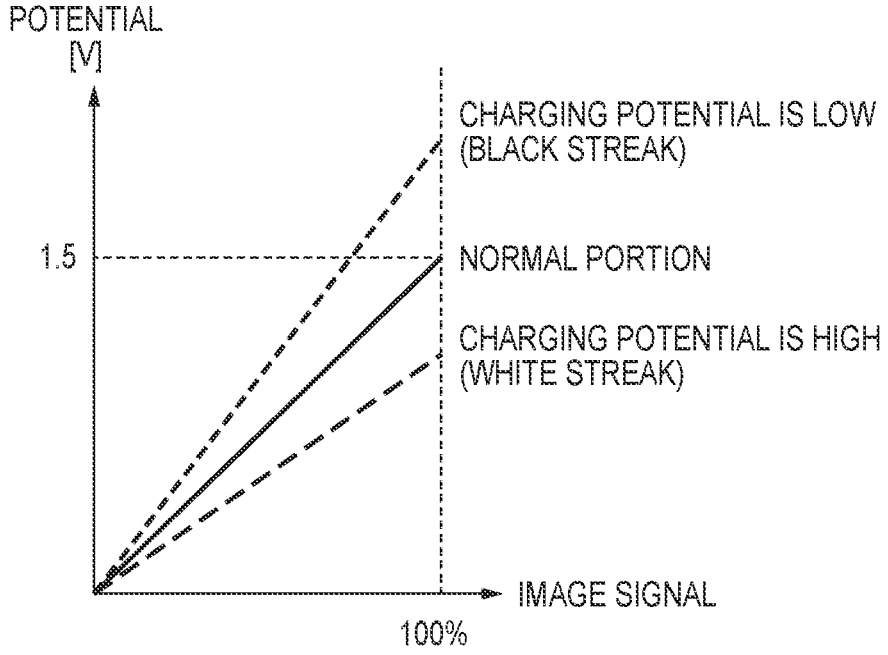

A contact charging scheme in which the photosensitive drum 11 is caused to be in contact with a charging member to perform charging is employed for the charger unit 12 of the present embodiment. In the contact charging scheme, an additive agent such as silicone may adhere to the charging member due to insufficient cleaning at a position in the main scanning direction on the surface of the photosensitive drum 11. FIG. 12A is a view that illustrates the surface potential (the charging potential) of the photosensitive drum 11. FIG. 12B is a view for illustrating a relationship between an image signal and optical density. As illustrated by FIG. 12A, the resistance of a charging member increases at main scanning positions for a portion of surface of the photosensitive drum 11, and the charging potential for these positions increases. A main scanning region at which the resistance became larger is called a high resistance portion. When the charging potential increases, as illustrated by FIG. 12B, even if each main scanning position of the photosensitive drum 11 is exposed using the same image signal, the density of the high resistance portion becomes less than the predetermined density (0.6), and a white streak occurs.

Meanwhile, toner adheres to the charging member when a cleaning defect occurs in the main scanning position in a portion of the surface of the photosensitive drum 11. The resistance of a part at which toner adheres in the surface of the charging member becomes lower. The resistance of the charging member gradually increases due to endurance, but the resistance of the charging member becomes partially lower even if a surface layer of the charging member is stripped off. As a result, as illustrated by FIG. 12A, the resistance of a charging member at a portion of the main scanning region partially decreases, and the charging potential decreases. This portion is called a low resistance portion. When the charging potential decreases, as illustrated by FIG. 12B, even if each main scanning position of the photosensitive drum 11 is exposed using the same image signal, the density of the low resistance portion becomes higher than the predetermined density (0.6), and a black streak occurs.

Characteristics of a charge defect streak are described using FIG. 7. Firstly, a streak does not occur in a plain region W-P where an image pattern is not formed. The color out of YMCBk where a streak occurs is the color the charger unit 12 that caused a charge defect is responsible for.

Figure 13A:
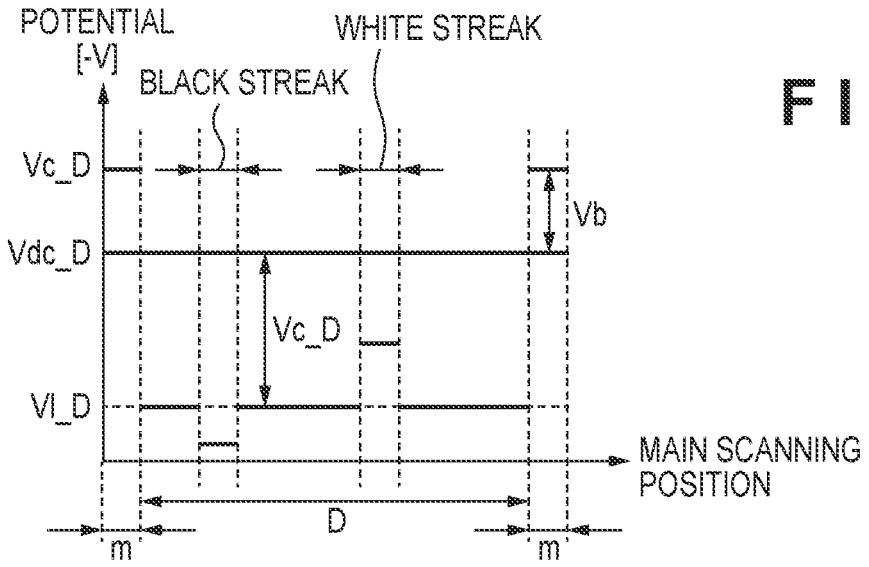
FIGS. 13A to 13F are views for describing a relationship among streaks, latent image potential, charging potential, and developing potential.
Figure 13B:
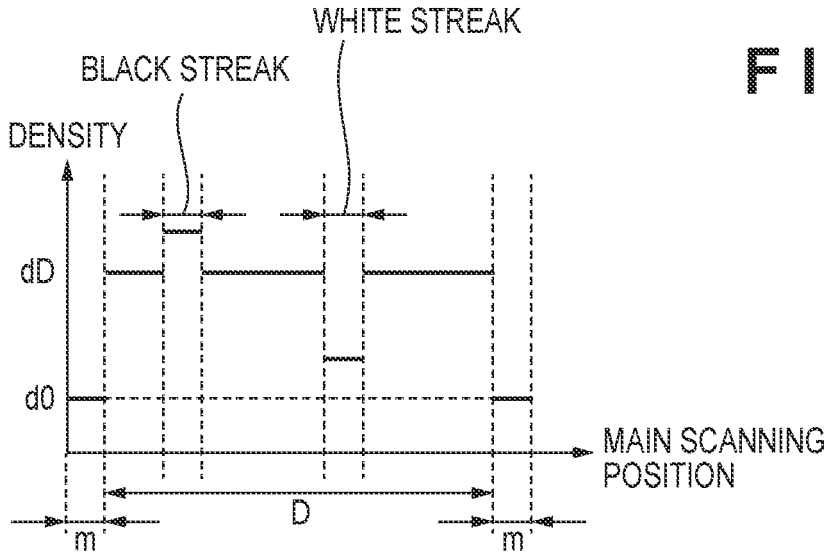
Figure 13C:
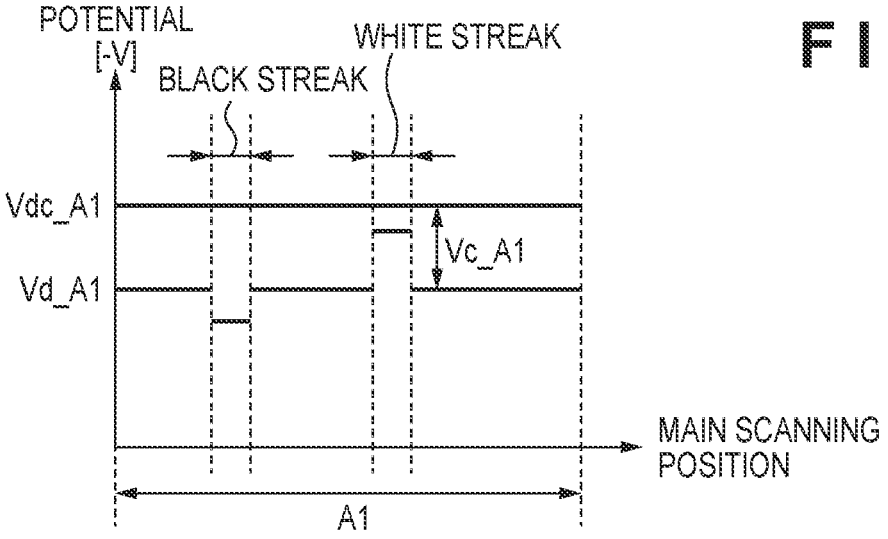
Figure 13D:
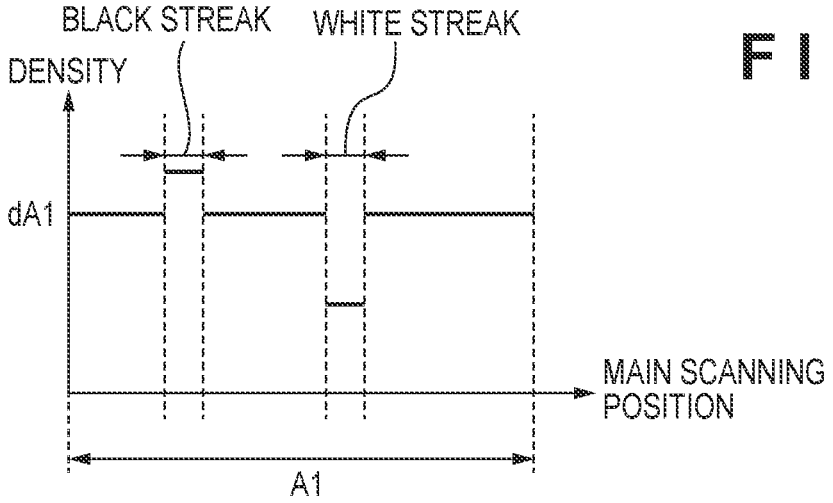
Figure 13E:
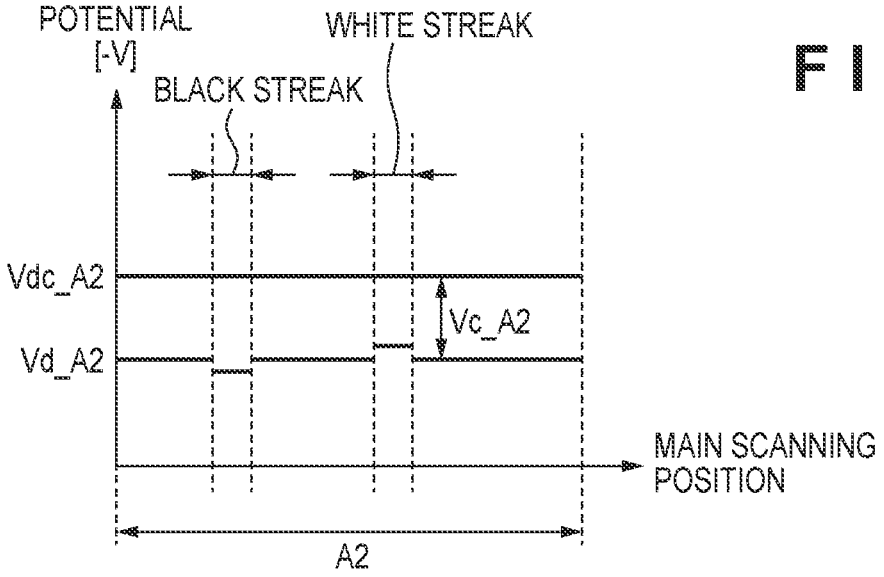
Figure 13F:
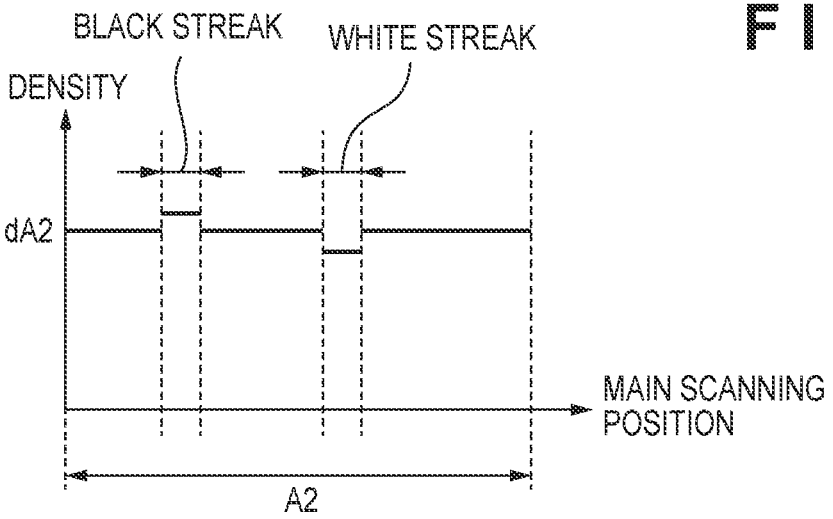

FIG. 13A illustrates potentials at each main scanning position of the photosensitive drum 11 when a digital pattern D-P is formed. FIG. 13B illustrates optical density at each main scanning position of a sheet S when the digital pattern D is formed. FIG. 13C illustrates potentials at each main scanning position of the photosensitive drum 11 when an analog pattern A1-P is formed. FIG. 13D illustrates optical density at each main scanning position of a sheet S when an analog pattern A1-P is formed. FIG. 13E illustrates potentials at each main scanning position of the photosensitive drum 11 when an analog pattern A2-P is formed. FIG. 13F illustrates optical density at each main scanning position of a sheet S when an analog pattern A2-P is formed.

As illustrated by FIG. 13A and FIG. 13B, the charging potential at the main scanning positions of a portion of the photosensitive drum 11, which is exposed by the digital pattern D-P, differs from V1_D. A black streak occurs at a position where the charging potential is lower than V1_D, and a white streak occurs at a position where the charging potential is higher than V1_D. As illustrated by FIG. 13C and FIG. 13D, a black streak or a white streak occur even with the analog pattern A1-P because the charging potential at a portion in the main scanning direction differs from Vd_A1. Because the charge defect occurs due to a charging member resistance difference, the charge defect is reduced by causing the charging potential of the charger unit 12 to decrease. As illustrated by FIG. 13E and FIG. 13F, the impact of a charge defect is smaller with the analog pattern A2-P, in comparison to the analog pattern A1-P. That is, the streak improves. A streak improving means that the difference between the optical density of the streak and the surrounding optical density (0.6) decreases. That is, when a streak improves, it becomes more difficult to notice the streak visually.

Streak Caused by a Plasticity Deformation of the Intermediate Transfer Belt

Figure 10B:
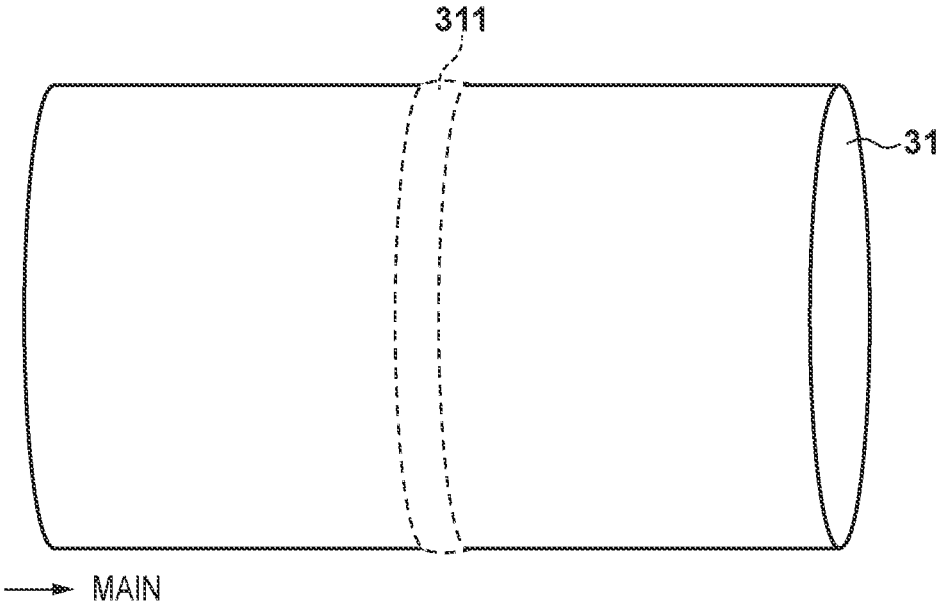

Next, a streak due to a plasticity deformation of the intermediate transfer belt 31 indicated by FIG. 7 is described. An inner surface of the intermediate transfer belt 31 that is used for a long period may be scraped, producing a powder. For example, a portion of a part that configures the transfer cartridge may adhere to the surface of the rollers 36 and 37. As illustrated by FIG. 10B, a portion of the intermediate transfer belt 31 is subject to a plasticity deformation to become a convex shape. Such a portion is called a convex portion 311. When the convex portion 311 occurs on the intermediate transfer belt 31 in this way, it becomes difficult for both sides of the convex portion 311 to be in contact with the photosensitive drum 11 or a sheet S. Accordingly, it becomes difficult to secondary transfer a toner image to the sheet S at both side portions, and white streaks occur. A black streak occurs for the convex portion 311 because a lot of toner secondary transfers to the sheet S. Accordingly, the part to be replaced in order to resolve a streak due to a plasticity deformation of the intermediate transfer belt 31 is the transfer cartridge. Note that a white streak is not a streak of a white color, but rather is a pale streak where the density is low (there is less toner). Also, a black streak is a dense streak where the density is high (there is more toner).

Characteristics of a streak due to a plasticity deformation are described using FIG. 7. Firstly, a streak does not occur in a plain region W-P where an image pattern is not formed. Colors out of YMCBk where a streak occurs are all colors. This is because a streak of this type occurs in a secondary transfer unit. In addition, because there is no relationship between the existence or absence of exposure and a charging potential, streaks occur even with the analog patterns A1-P and A2-P in addition to the digital pattern D-P.

Streak Caused by a Photosensitive Drum Cleaning Defect

A streak caused by a defect in cleaning of the photosensitive drum 11 is a black streak. A portion of the cleaning blade of the drum cleaner 15 is defective. This defective part cannot scrape off toner remaining on the photosensitive drum 11 after the primary transfer. This becomes the cause of a black streak. This black streak occurs for a color that the drum cleaner 15, in which the cleaning defect occurred, is responsible for. Note that a black streak caused by a cleaning defect occurs as an approximately straight line shaped streak in the plain region W-P. Accordingly, the part to be replaced in order to reduce streaks due to a cleaning defect of the photosensitive drum 11 is the process cartridge 50.

Characteristics of a streak due to a cleaning defect are described using FIG. 7. Because streaks due to a cleaning defect occur, streaks also occur in the plain region W-P in which an image pattern is not formed. The color of a streak that occurs in the plain region W-P is the same color as the color of toner accumulated on the drum cleaner 15. Thus the type of the streak is a monochrome streak. Because the streak occurs even for a color for which an image is not formed, it occurs in patterns of all of the colors of yellow, magenta, cyan, and black. For example, when the drum cleaner 15 responsible for yellow is defective, a yellow streak occurs across all regions in the sub scanning direction of the sheet S, and thus a streak occurs in patterns of all colors. In addition, because there is no relationship between the existence or absence of exposure and a charging potential, streaks occur with any of the analog patterns A1-P and A2-P and the digital patterns D-P.

Streak Caused by an Intermediate Transfer Belt Cleaning Defect

A black streak that occurs due to a cleaning defect of the intermediate transfer belt 31 is described using FIG. 7. When a portion of a member (a blade or the like) that makes contact with the intermediate transfer belt 31 in the transfer cleaner 35 is defective, a black streak occurs. This occurs because toner remaining on the intermediate transfer belt 31 after the secondary transfer cannot be scraped off. The color of a streak of this type is a color in which yellow, magenta, cyan, and black toner is mixed (a mixed color). Thus, the unit that should be replaced to reduce a black streak that occurs due to a defect in cleaning the intermediate transfer belt 31 is the transfer cleaner 35.

Characteristics of a streak that occurs due to a cleaning defect of the intermediate transfer belt 31 are described using FIG. 7. Because a cleaning defect is the cause, streaks also occur in the plain region W-P in which an image pattern is not formed. A streak that occurs in the plain region W-P is in accordance with toner that has accumulated on the transfer cleaner 35, and thus the color of the streak is a mixture of colors of yellow, magenta, cyan, and black. In addition, because there is no relationship between the existence or absence of exposure and a charging potential, streaks occur with any of the analog patterns A1-P and A2-P and the digital patterns D-P.

[Replacement Part Identification Processing]

Figure 14:
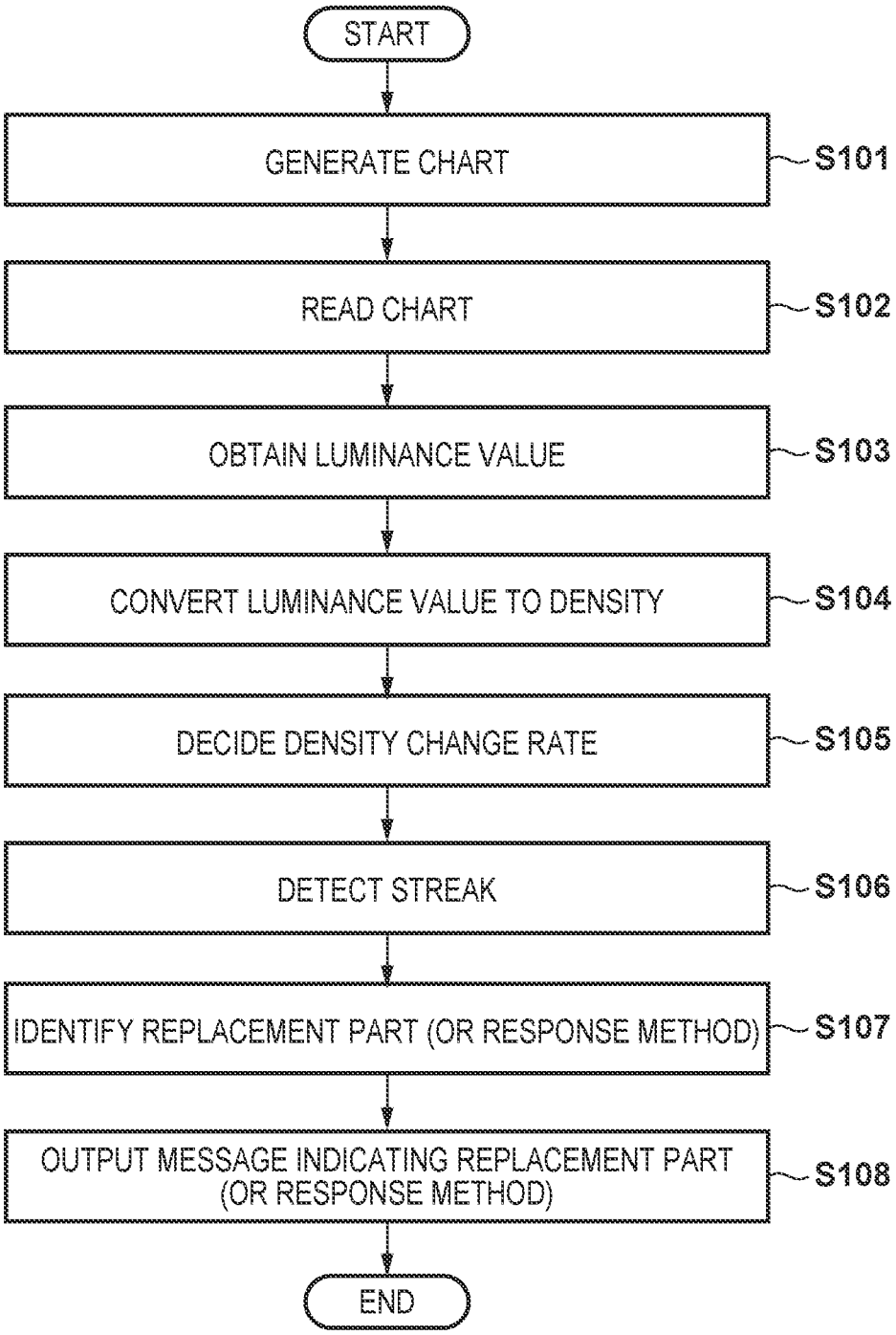
FIG. 14 is a flowchart for illustrating processing for generating a chart and processing for identifying a replacement part.

Processing for generating a chart and replacement part identification processing for identifying a replacement part are described using FIG. 14. Upon being input with an instruction for identifying a replacement part or an instruction for generating the charts 301, 302, and 303 from the input apparatus 62, the CPU 60 executes the following processing.

In step S101, the CPU 60 (the chart generation unit 64) controls the printer 3 to generate the charts 301 through 303. The CPU 60 controls the printer 3 to cause the digital patterns D-P, the analog patterns A1-P, the analog patterns A2-P, and the camouflage patterns W-Ca, D-Ca, A1-Ca, and A2-Ca to be formed on sheets S.

In the case of forming a plain region W-P, the charging controller 65 controls the charging power supply 68 so that the surface potential of the photosensitive drum 11 becomes the charging potential Vd_D. In a case of forming the plain region W-P, the developing controller 66 controls the developing power supply 69 so that the potential of the developing sleeve of the developing unit 14 becomes a developing potential Vdc_D. To form the camouflage pattern W-Ca on the plain region W-P, the exposure unit 13 exposes the photosensitive drum 11 based on the camouflage pattern W-Ca. The exposure unit 13 does not exposure a position where the camouflage pattern is not to be formed in the plain region W-P. By this, the plain region W-P to which the camouflage pattern W-Ca has been added is formed on a sheet S (the chart 301).

Next, in a case of forming the yellow digital pattern D-P-Y, the charging controller 65 controls the charging power supply 68 so that the surface potential of the photosensitive drum 11*y* becomes the charging potential Vd_D. The exposure unit 13*y* exposes the photosensitive drum 11*y* based on pattern image data for forming the digital pattern D-P-Y. In a case of forming the digital pattern D-P-Y, the developing controller 66 controls the developing power supply 69 so that the potential of the developing sleeve of the developing unit 14*y* becomes the developing potential Vdc_D. In order to superimpose the blue camouflage pattern D-Ca-Y (a mixed color pattern) on the digital pattern D-P-Y, the charging controller 65 controls the charging power supply 68 so that the surface potentials of the photosensitive drums 11*m* and 11*c* become the charging potential Vd_D. The exposure units 13*m* and 13*c* expose the photosensitive drums 11*m* and 11*c* based on pattern image data for forming the camouflage pattern D-Ca-Y. In order to form the camouflage pattern D-Ca-Y, the developing controller 66 controls the developing power supply 69 so that the potential of the developing sleeves of the developing units 14*m* and 14*c* become the developing potential Vdc_D. As a result, the blue, which is a complementary color for yellow, camouflage pattern D-Ca-Y (a mixed color pattern) is added to the digital pattern D-P-Y.

The magenta digital pattern D-P-M, the cyan digital pattern D-P-C, and the black digital pattern D-P-Bk are similarly formed. Here, a green camouflage pattern D-Ca-M (a mixed color pattern) is formed on the magenta digital pattern D-P-M, and a red camouflage pattern D-Ca-C (a mixed color pattern) is formed on the cyan digital pattern D-P-C. However, because there is no complementary color for black, the green camouflage pattern D-Ca-Bk (a mixed color pattern) is formed on the black digital pattern D-P-Bk. This is because green is a color that has $\Delta E00 \geq 3.0$ or more with respect to black.

In a case of forming a yellow analog pattern A1-P-Y, the charging controller 65 controls the charging power supply 68 so that the surface potential of the photosensitive drum 11*y* becomes the charging potential Vd_A1. In a case of forming the yellow analog pattern A1-P-Y, the developing controller 66 controls the developing power supply 69 so that the potential of the developing sleeve of the yellow developing unit 14*y* becomes the developing potential Vdc_A1. In order to superimpose the blue camouflage pattern A1-Ca-Y (a mixed color pattern) on the yellow analog pattern A1-P-Y, the charging controller 65 controls the charging power supply 68 so that the surface potentials of the photosensitive drums 11*m* and 11*c* become the charging potential Vd_Ca. The charging potential Vd_Ca is set to a value that is the same as the charging potential Vd_D, for example. The exposure units 13*m* and 13*c* expose the photosensitive drums 11*m* and 11*c*, based on the pattern image data for forming the camouflage pattern A1-Ca-Y. In order to form the camouflage pattern A1-Ca-Y, the developing controller 66 controls the developing power supply 69 so that the potential of the developing sleeves of the developing units 14*m* and 14*c* becomes the developing potential Vdc_Ca. The developing potential Vdc_Ca is set to a value that is the same as the developing potential Vdc_D, for example. When the camouflage pattern A1-Ca-Y is formed, the absolute value of the developing potential Vdc_Ca is smaller than the absolute value of the charging potential Vd_Ca. As a result, the blue, which is a complementary color for yellow, camouflage pattern A1-Ca-Y (a mixed color pattern) is added to the analog pattern A1-P-Y.

The magenta analog pattern A1-P-M, the cyan analog pattern A1-P-C, and the black analog pattern A1-P-Bk are similarly formed. Here, a green camouflage pattern A1-Ca-M (a mixed color pattern) is formed on the magenta analog pattern A1-P-M, and a red camouflage pattern A1-Ca-C (a mixed color pattern) is formed on the cyan analog pattern A1-P-C. However, because there is no complementary color for black, the green camouflage pattern A1-Ca-Bk (a mixed color pattern) is formed on the black analog pattern A1-P-Bk. This is because green is a color that has $\Delta E00 \geq 3.0$ or more with respect to black.

In a case of forming a yellow analog pattern A2-P-Y, the charging controller 65 controls the charging power supply 68 so that the surface potential of the photosensitive drum 11*y* becomes the charging potential Vd_A2. In a case of forming the yellow analog pattern A2-P-Y, the developing controller 66 controls the developing power supply 69 so that the potential of the developing sleeve of the yellow developing unit 14*y* becomes the developing potential Vdc_A2. In order to superimpose the blue camouflage pattern A2-Ca-Y (a mixed color pattern) on the yellow analog pattern A2-P-Y, the charging controller 65 controls the charging power supply 68 so that the surface potentials of the photosensitive drums 11*m* and 11*c* become the charging potential Vd_Ca. The exposure units 13*m* and 13*c* expose the photosensitive drums 11*m* and 11*c*, based on the pattern image data for forming the camouflage pattern A2-Ca-Y. In order to form the camouflage pattern A2-Ca-Y, the developing controller 66 controls the developing power supply 69 so that the potential of the developing sleeves of the developing units 14*m* and 14*c* becomes the developing potential Vdc_Ca. When the camouflage pattern A2-Ca-Y is formed, the absolute value of the developing potential Vdc_Ca is smaller than the absolute value of the charging potential Vd_Ca. As a result, the blue, which is a complementary color for yellow, camouflage pattern A2-Ca-Y (a mixed color pattern) is added to the analog pattern A2-P-Y.

The magenta analog pattern A2-P-M, the cyan analog pattern A2-P-C, and the black analog pattern A2-P-Bk are similarly formed. Here, a green camouflage pattern A2-Ca-M (a mixed color pattern) is formed on the magenta analog pattern A2-P-M, and a red camouflage pattern A2-Ca-C (a mixed color pattern) is formed on the cyan analog pattern A2-P-C. However, because there is no complementary color for black, the green camouflage pattern A2-Ca-Bk (a mixed color pattern) is formed on the black analog pattern A2-P-Bk. This is because green is a color that has $\Delta E00 \geq 3.0$ or more with respect to black.

In step S102, the CPU 60 (the diagnostic unit 67) controls the image reader 2 to read the charts 301, 302, and 303. A user or a service person places the chart 301 on the platen glass 22, and presses the read start button of the input apparatus 62. As a result, the image reader 2 outputs the read data of the chart 301 to the diagnostic unit 67. The diagnostic unit 67 obtains the read data of the chart 301 outputted from the image reader 2. Similarly a user or a service person places the chart 302 and the chart 303 on the platen glass 22 and presses the read start button. The diagnostic unit 67 obtains the read data of the charts 302 and 303 outputted from the image reader 2. The read data for the charts 301, 302, and 303 is stored in the storage apparatus 63.

In step S103, the CPU 60 (the diagnostic unit 67) obtains luminance values from the read data. The position of the plain region W-P in the chart 301 and the positions of the digital patterns D-P-Y, D-P-M, D-P-C, and D-P-Bk are decided in advance. The diagnostic unit 67 extracts, from the read data of the chart 301 stored in the storage apparatus 63, read data for a detection range corresponding to the plain region W-P, and read data of detection ranges respectively corresponding to the digital patterns D-P-Y, D-P-M, D-P-C, and D-P-Bk. In addition, the positions of the analog patterns A1-P-Y, A1-P-M, A1-P-C, and A1-P-Bk in the chart 302 are decided in advance. The diagnostic unit 67 extracts, from the read data of the chart 302 stored in the storage apparatus 63, the read data of detection ranges respectively corresponding to the analog patterns A1-P-Y, A1-P-M, A1-P-C, and A1-P-Bk. Similarly, the positions of the analog patterns A2-P-Y, A2-P-M, A2-P-C, and A2-P-Bk in the chart 303 are decided in advance. The diagnostic unit 67 extracts, from the read data of the chart 303 stored in the storage apparatus 63, the read data of detection ranges respectively corresponding to the analog patterns A2-P-Y, A2-P-M, A2-P-C, and A2-P-Bk.

Next, the diagnostic unit 67 extracts results of reading pixels in a complementary color relationship with the color of an image pattern. Read results for R pixels are extracted for a cyan image pattern. Read results for G pixels are extracted for a magenta image pattern. Read results for B pixels are extracted for a yellow image pattern. Read results for G pixels are extracted for black because it does not have a complementary color. These read results are luminance values. Note that the image sensor of the image reader 2 is a CCD sensor, a CMOS sensor, or the like, and has R pixels, G pixels, and B pixels. Because a red filter is provided for an R pixel, it cannot read a camouflage pattern formed by red. By this, the diagnostic unit 67 can obtain read data in which the camouflage pattern has been removed or reduced from the image pattern read result. By a similar principle for magenta, yellow, and black, camouflage patterns are removed or reduced in image pattern read results.

The diagnostic unit 67 obtains an average value of luminance values of each row of n pixels that configure a detection range. For example, assume that a detection range is configured by a pixel group having n rows×m columns. This pixel group has n pixels lined up in an X direction (the sub scanning direction), and m pixels lined up in a Y direction (the main scanning direction). Firstly, the diagnostic unit 67 obtains a sum of respective luminance values of the n pixels included in a first column, and divides this sum by n. As a result, an average luminance value of the first column in the detection range is obtained. The diagnostic unit 67 obtains an average luminance value for each of the second column to the m-th column, similarly to for the first column.

In step S104, the CPU 60 (the diagnostic unit 67) uses a density conversion table stored in the storage apparatus 63 to convert the m luminance values (averages) to densities. The density conversion table is stored in a ROM of the storage apparatus 63 at a time of shipment from a factory of the image forming apparatus 1.

In step S105, the CPU 60 (the diagnostic unit 67) decides a density change rate for each column. The density change rate is decided based on the following equation, for example.

$$\text{Density change rate}=(\text{density of target column}-\text{density of other column different from target column})/\text{density of target column} \quad (1)$$

Here, the density of the other column different from the target column is, for example, the density of a column adjacent to the target column. For example, a column adjacent to an i-th column is an (i−1)-th column (i>1).

In step S106, the CPU 60 (the diagnostic unit 67) detects a streak from a result of reading the charts 301 through 303. For example, the diagnostic unit 67 determines that there is a streak in a target column if the density change rate of the target column is greater than a threshold value. The threshold value is 7%, for example.

A vertical streak may occur across a plurality of columns lined up in the Y direction (the main scanning direction). In a case where there is a vertical streak in both an i-th target column and an i+1-th target column, it is not possible to determine a vertical streak when Equation (1) is applied unchanged. Accordingly, a design as below is necessary. Assume that the diagnostic unit 67 does not detect a vertical streak in the i−1-th column, but detects a vertical streak in the subsequent i-th target column. In such a case, the diagnostic unit 67 obtains the density change rate of the i+1-th target column after keeping the i−1-th column as the other column for the i+1-th target column in Equation (1). By this, it is possible to detect a vertical streak that occurs in the i+1-th column. Note that step S105 and step S106 are repeatedly executed for each column from the first column until the m-th column.

The diagnostic unit 67 distinguishes a streak whose density is greater than the predetermined density (0.6) as a black streak, and distinguishes a streak whose density is lower than the predetermined density (0.6) as a white streak. The diagnostic unit 67 stores, in the storage apparatus 63, the position at which the streak was detected in the Y direction (the main scanning direction), the color of the streak, and a luminance difference between a luminance corresponding to the predetermined density and the luminance of the streak as feature amounts of the streak. Note that the position where the streak was detected indicates where the streak occurred among the plain region W-P, the digital patterns D-P, and the analog patterns A1-P and A2-P. A charging potential for forming the analog patterns A1-P is higher than a charging potential for forming the analog patterns A2-P. Accordingly, if a luminance difference for a streak that occurs in the analog patterns A2-P is less than a luminance difference for a streak that occurs in the analog patterns A1-P, it is determined that the streak is due to a charge defect of the charger unit 12. In contrast, if a luminance difference for a streak that occurs in the analog patterns A2-P is greater than a luminance difference for a streak that occurs in the analog patterns A1-P, it is determined that the streak is due to a developing defect of the developing unit 14.

Processing as below is executed for a detection region of the plain region W-P. The CPU 60 calculates an average value of the luminance values of each row for each of R pixels, G pixel, and B pixels. The average luminance value of the R pixels is converted to a density Dr. The average luminance value of the G pixels is converted to a density Dg. The average luminance value of the B pixels is converted to a density Db. The CPU 60 determines that a streak has occurred if at least one the densities Dr, Dg, and Db is greater than a predetermined density. Furthermore, the CPU 60 determines whether the color of the streak is a monochrome or a mixed color, based on a combination of the densities Dr, Dg, and Db.

In step S107, the CPU 60 (the diagnostic unit 67) identifies the cause of the streak and a replacement part (or a response method) based on a result of reading the charts 301 through 303 (a streak detection result). In other words, the diagnostic unit 67 determines a fault location (a causal part that generated a streak) based on the read data. For example, the diagnostic unit 67 distinguishes the existence or absence of a streak and the color (monochrome (YMCBk)/mixed color, or the like) of the streak for each image pattern or plain region W-P based on streak feature amounts stored in the storage apparatus 63. The diagnostic unit 67 identifies the cause and the replacement part by comparing the result of distinguishing with an identification condition for identifying the cause and replacement part.

In step S108, the CPU 60 (the diagnostic unit 67) displays on the display apparatus 61 a message indicating the replacement part or the response method or transmits this message to the PC 124 or the server 128 via the communication IF 55. For example, a causal part that generated a streak is displayed on a display of the display apparatus 61.

FIG. 15 illustrates an example of a message indicating a replacement part or a response method. The message includes information such as that a vertical streak (a streak that extends in the sub scanning direction) has occurred in the charts 301 through 303, a code indicated a cause, and a name of a replacement part. A user or a service person can easily understand what the cause of the streak is and what the replacement part is by referring to the message. Note that if a vertical streak is not detected, the diagnostic unit 67 displays on the display apparatus 61 a message indicating that the image forming apparatus 1 is normal. In this way, a user, a service person or the like can easily comprehend what the replacement part is because they can know that a vertical streak occurred and what the replacement part is by the specific information.

[Details of Replacement Part Identification Processing]

Figure 16A:
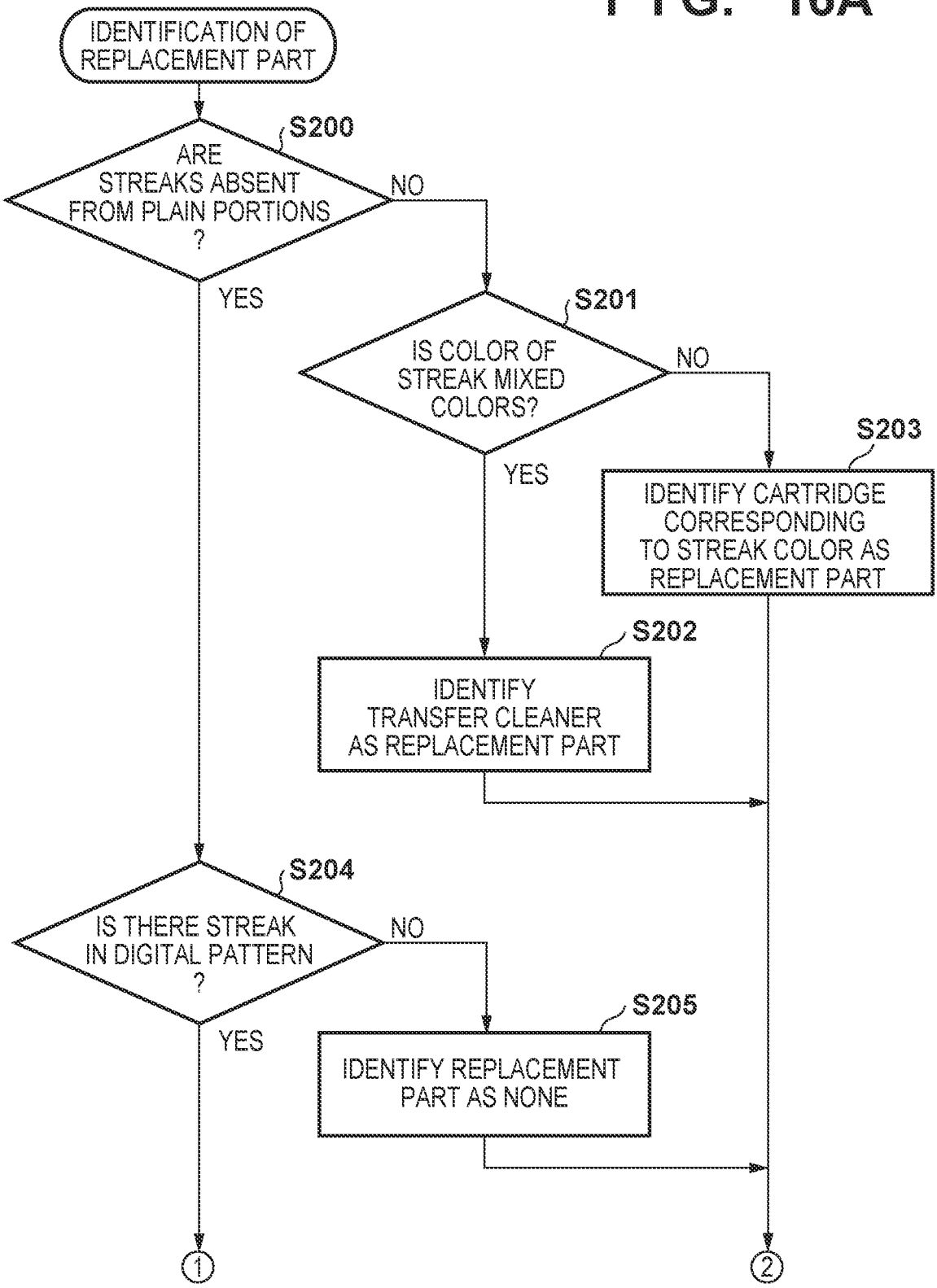
FIGS. 16A and 16B are flowcharts illustrating processing for identifying a replacement part.
Figure 16B:
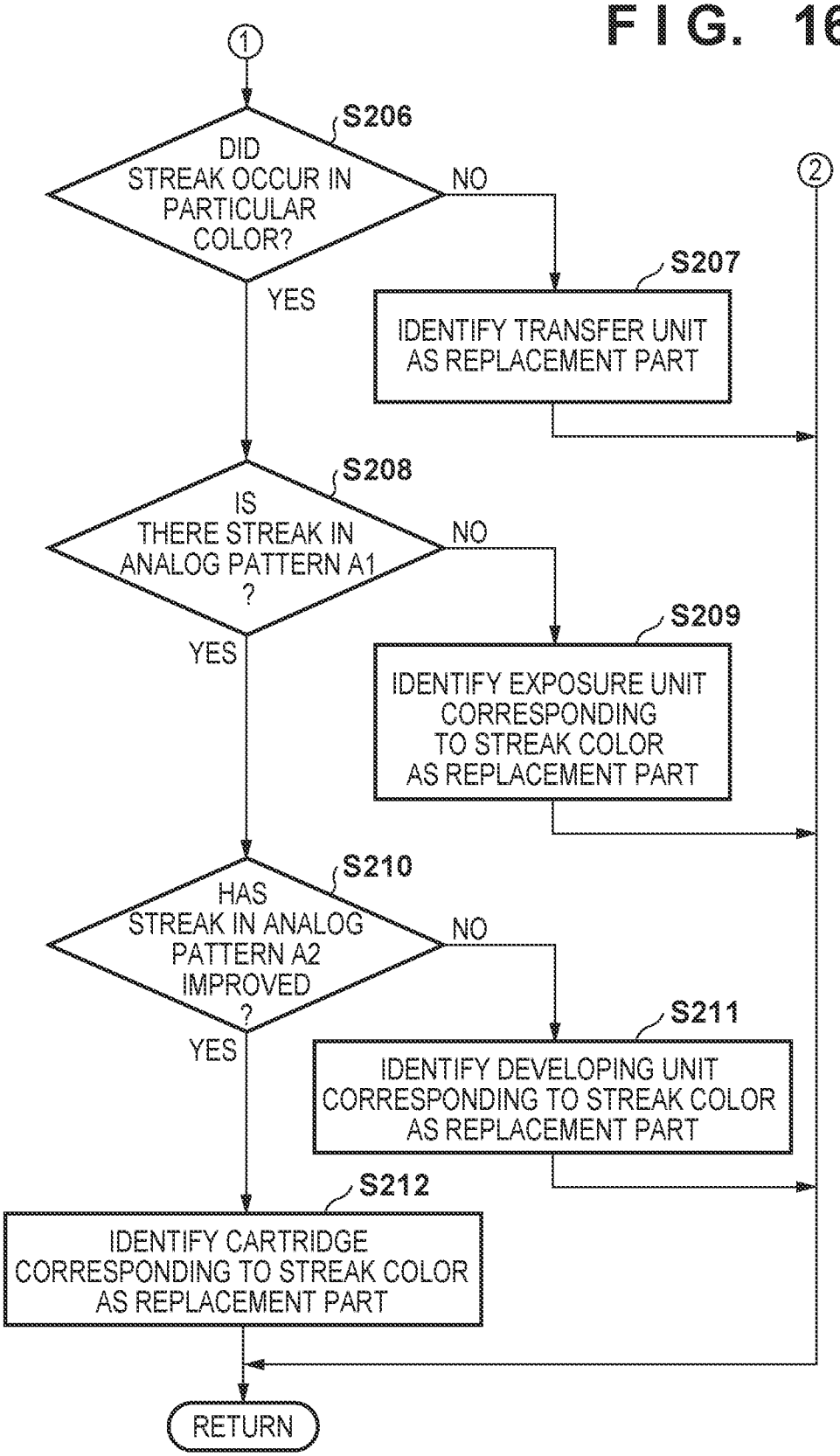

FIGS. 16A and 16B are flowcharts illustrating details of processing for identifying a replacement part and a response method. The CPU 60 (the diagnostic unit 67) attempts to detect a vertical streak at each main scanning position (example: every 1 mm). Accordingly, a vertical streak may be detected at a plurality of main scanning positions. In addition, there is the possibility that the causes of a plurality of vertical streaks are respectively different. Accordingly, the CPU 60 (the diagnostic unit 67) identifies the cause and the replacement part for each streak. Note that the replacement part may be identified by identifying the cause of the occurrence of the streak. The determination processing illustrated in FIGS. 16A and 16B may be a set of identification conditions for identifying a replacement part or a cause.

In step S200, the CPU 60 reads feature amounts from the storage apparatus 63, and determines whether a streak is not present in the plain region W-P. The coordinates of the plain region W-P in the chart 301 are known beforehand. The CPU 60 compares the position of a streak and the coordinates of the plain region W-P to distinguish existence or absence of a streak in the plain region W-P. If there is a streak in the plain region W-P, the CPU 60 proceeds to step S201.

In step S201, the CPU 60 determines whether or not the color of the streak is a mixed color. If the color of the streak is a mixed color, the CPU 60 advances to step S202. In step S202, the CPU 60 distinguishes that the cause of the streak is a defect in cleaning the intermediate transfer belt 31, and identifies the transfer cleaner 35 as the replacement part. Meanwhile, if the color of the streak is a monochrome of any of YMCBk, the CPU 60 advances to step S203.

In step S203, the CPU 60 distinguishes the cause of the streak to be a cleaning defect of the photosensitive drum 11, and identifies the process cartridge 50 corresponding to the color of the streak as the replacement part. If a streak in the plain region W-P was not detected in step S200, the CPU 60 advances to step S204.

In step S204, the CPU 60 reads feature amounts from the storage apparatus 63, and determines whether a streak is present in the digital patterns D-P-Y through D-P-Bk. The coordinates of the digital patterns D-P-Y through D-P-Bk in the charts 301 through 303 are known beforehand. The CPU 60 compares the coordinates of the digital patterns D-P-Y through D-P-Bk with the position of a streak to distinguish existence or absence of a streak in the digital patterns D-P-Y through D-P-Bk. If there is no streak in any of the digital patterns D-P-Y through D-P-Bk, the CPU 60 advances to step S205.

In step S205, the CPU 60 identifies that there is no replacement part (normal). Meanwhile, upon detecting a streak in any of the digital patterns D-P-Y through D-P-Bk, the CPU 60 advances to step S206.

In step S206, the CPU 60 reads feature amounts from the storage apparatus 63, and determines whether or not a streak occurs in a particular color. This is the same as determining whether a streak occurs in all colors (all of the digital patterns D-P-Y through D-P-Bk). If a streak is occurring for all colors, the CPU 60 advances to step S207.

In step S207, the CPU 60 distinguishes that the cause of the streak is a plasticity deformation of the intermediate transfer belt 31, and identifies a transfer cartridge which includes the intermediate transfer belt 31 as the replacement part. Meanwhile, if a streak is occurring for a particular color, the CPU 60 advances to step S208.

In step S208, the CPU 60 determines whether a streak has occurred in an analog pattern A1-P of the same color as the color of a digital pattern D-P where a streak occurred. If there is no streak in the analog pattern A1-P, the CPU 60 advances to step S209.

In step S209, the CPU 60 distinguishes that the cause of the streak is an exposure defect, and identifies the exposure unit 13 corresponding to the color of the streak as the replacement part. Note that the CPU 60 may identify cleaning of the exposure unit 13 corresponding to the color of the streak as the response method. When a streak has occurred in an analog pattern A1-P of the same color as the color where a streak occurred in the digital pattern D-P, the CPU 60 advances to step S210.

In step S210, the CPU 60 determines whether a streak in an analog pattern A2-P has improved with respect to a streak in an analog pattern A1-P. Note that the analog pattern A1 and the analog pattern A2 are of the same color. For example, the CPU 60 may read feature amounts from the storage apparatus 63 and compare a luminance difference (a density difference) for a streak in the analog pattern A1-P with a luminance difference (a density difference) for a streak in the analog pattern A2. If the streak in the analog pattern A2-P has not improved in comparison to the streak in the analog pattern A1-P, the CPU 60 advances to step S211.

In step S211, the CPU 60 distinguishes that the cause of the streak is a developing coat defect, and identifies the developing unit 14 corresponding to the color of the streak as the replacement part. Meanwhile, if the density difference of the streak in the analog pattern A2-P is less than the density difference of the streak in the analog pattern A1-P, the streak has improved and the CPU 60 advances to step S212. In step S212, the CPU 60 distinguishes the cause of a streak to be a charge defect, and identifies the process cartridge 50 corresponding to the color of the streak as the replacement part.

In this way, the CPU 60 generates the charts 301 through 303 and analyzes streaks that occur in the charts 301 through 303 to identify a replacement part and a cause of the streaks. Also, the CPU 60 may output a message indicating the cause of the streak and the replacement part to the display apparatus 61 or the like. By this, it becomes possible for a user or a service person to easily recognize the cause of the streak and the replacement part. Thereby, the work time (downtime) necessary for maintenance may be significantly shortened. Also, because a part involved in the streak is identified, it may be that the replacement of a part that is not involved in the streak may be avoided. Thereby, maintenance costs may also be reduced as well as maintenance time. The message indicating the cause of the streak and the replacement part may be transmitted to the server 128 of the service person via the network. Because the service person can know what the replacement part is in advance, he or she can reliably bring the replacement part to perform the maintenance. Processing illustrated in FIGS. 16A and 16B for identifying, for example, a replacement part or a cause of a streak may be executed with a user or a service person visually observing the charts 301 through 303. Here, a color printer is employed as an example, but the present embodiment may be applied to a monochrome printer.

In this way, the CPU 60 generates the charts 301 through 303 and analyzes streaks that occur in the charts 301 through 303 to identify a replacement part and a cause of the streaks. Also, the CPU 60 may output a message indicating the cause of the streak and the replacement part to the display apparatus 61 or the like. By this, it becomes possible for a user or a service person to easily recognize the cause of the streak and the replacement part. Thereby, the work time (downtime) necessary for maintenance may be significantly shortened. Also, because a part involved in the streak is identified, it may be that the replacement of a part that is not involved in the streak may be avoided. Thereby, maintenance costs may also be reduced as well as maintenance time. The message indicating the cause of the streak and the replacement part may be transmitted to the server 128 of the service person via the network. Because the service person can know what the replacement part is in advance, he or she can reliably bring the replacement part to perform the maintenance. Processing for identifying, for example, a replacement part or a cause of a streak may be executed with a user or a service person visually observing the charts 301 through 303. Here, a color printer is employed as an example, but the present embodiment may be applied to a monochrome printer.

The charts 301 through 303 illustrated in FIG. 3 are merely an example. The order of the plain region W-P, the digital pattern D-P, and the analog patterns A1-P and A2-P in the charts 301 through 303 may be another order. It is sufficient if the plain region W-P, the digital pattern D, and the analog patterns A1-P and A2-P are included in a chart. In particular, to identify whether the cause of a streak is the charger unit 12 or the developing unit 14, it is sufficient if the analog patterns A1-P and A2-P are included in a chart.

A pattern image formed on a sheet S in accordance with the first embodiment is an example of a test image. The analog pattern A1 is an example of a first non-exposure image which is a toner image formed with a first charging potential (example: Vd_A1) being applied and without exposure being applied. The analog pattern A2 is an example of a second non-exposure image which is a toner image formed with a second charging potential different from the first charging potential (example: Vd_A2) being applied and without exposure being applied. It becomes possible to easily distinguish which of the charger unit 12 and the developing unit 14 to replace by using the two analog patterns having different charging potentials in this way. That is, by the present embodiment, the image forming apparatus 1 which forms a test image by which it is possible to identify which of a charging unit and a developing unit should be replaced is provided. Note that a user or service person may use the charts 301 through 303 to identify a replacement part visually, and the image forming apparatus 1 may read the charts 301 through 303 to identify a replacement part. In particular, camouflage patterns, which are for obscuring an image defect that a user or a service person is not interested in, are added to the test images. Consequently, an image defect that is not necessary to identify the replacement part is obscured.

Basically, a test image is formed by using toner of a single color. The color of a non-black test image and the color of a camouflage pattern added to the test image are in a complementary color relationship. This is because the camouflage pattern stands out with respect to the test image, and leads to a large camouflage effect. A green camouflage pattern may be added to a black test image. This is because there is no complementary color for black. Note that the CCD sensor 25 is an example of a reader device that has R pixels, G pixels, and B pixels, and reads a test image. The diagnostic unit 67 of the CPU 60 compares a result of reading a test image with identification conditions for identifying a replacement part to thereby identify the replacement part. The CCD sensor 25 uses a result of reading G pixels for a black test image, uses a result of reading B pixels for a yellow test image, uses a result of reading G pixels for a magenta test image, and uses a result of reading R pixels for a cyan test image. Consequently, an impact of the camouflage pattern on a result of reading a test image is reduced.

<Second Embodiment>

In the first embodiment, by generating the charts 301 through 303 that include a plurality of analog patterns A1-P and A2-P having the same optical density but different charging potentials, it is identified whether the cause of a streak is the charger unit 12 or the developing unit 14. However, it is difficult to detect a slight charge defect simply by causing the charging potential to differ. This is because with a slight charge defect, a difference between a streak in an analog pattern A1-P and a streak in an analog pattern A2-P does not become sufficiently large.

Accordingly, in the second embodiment, the image forming apparatus 1 performs charge processing in accordance with the charger unit 12 to form an analog pattern A1-P, but forms an analog pattern A2-P without performing charge processing in accordance with the charger unit 12. Consequently, the analog pattern A2-P becomes an image pattern that is not affected by the impact of a charge defect. For this reason, it is possible to detect even a slight charge defect by comparing an analog pattern A1-P formed by applying charge processing, and an analog pattern A2-P formed without applying charge processing. That is, it becomes possible to distinguish whether the cause of the streak is a charge defect or a developing coat defect. Note that the second embodiment is similar to the first embodiment except for a method for forming an analog pattern A2-P and processing for identifying a replacement part. Accordingly description of portions already described is omitted.

When forming an analog pattern A2-P without performing charge processing in accordance with the charger unit 12, it is difficult to add a camouflage pattern A2-Ca onto the analog pattern A2-P. This is because time for switching voltages is necessary. Accordingly, in the second embodiment, a pattern arrangement where it is possible to form an analog pattern A2-P without performing charge processing in accordance with the charger unit 12, and add a camouflage pattern A2-Ca is proposed.

[Method for Forming Analog Pattern A2-P]

In a contact charging scheme, when the charging controller 65 sets an applied voltage Vin to be applied to a charging member of the charger unit 12 to a discharge start voltage Vth or less, the charging potential Vd of the photosensitive drum 11 becomes approximately 0 [V]. In this way, in the second embodiment, the surface potential of the photosensitive drum 11 is controlled to be approximately 0[V] by setting the applied voltage Vin to a voltage (example: 0[V]) less than or equal to the discharge start voltage Vth (example: 400[V]).

Charge on the surface of the photosensitive drum 11 may be removed in order to further reduce an impact of the charger unit 12 on the analog pattern A2-P. For example, a pre-exposure light source (not shown) may expose the photosensitive drum 11 in relation to the surface of the photosensitive drum 11 which is cleaned by the drum cleaner 15. As a result the surface potential of the photosensitive drum 11 decreases to 0V. In a case where a non-contact charging scheme is used, configuration may be taken such that charge processing is not applied to the photosensitive drum 11, by controlling the charging power supply 68 so that the charging controller 65 does not supply current to a metal wire.

[Arrangement of Analog Patterns A1-P and A2-P]

Figure 17:
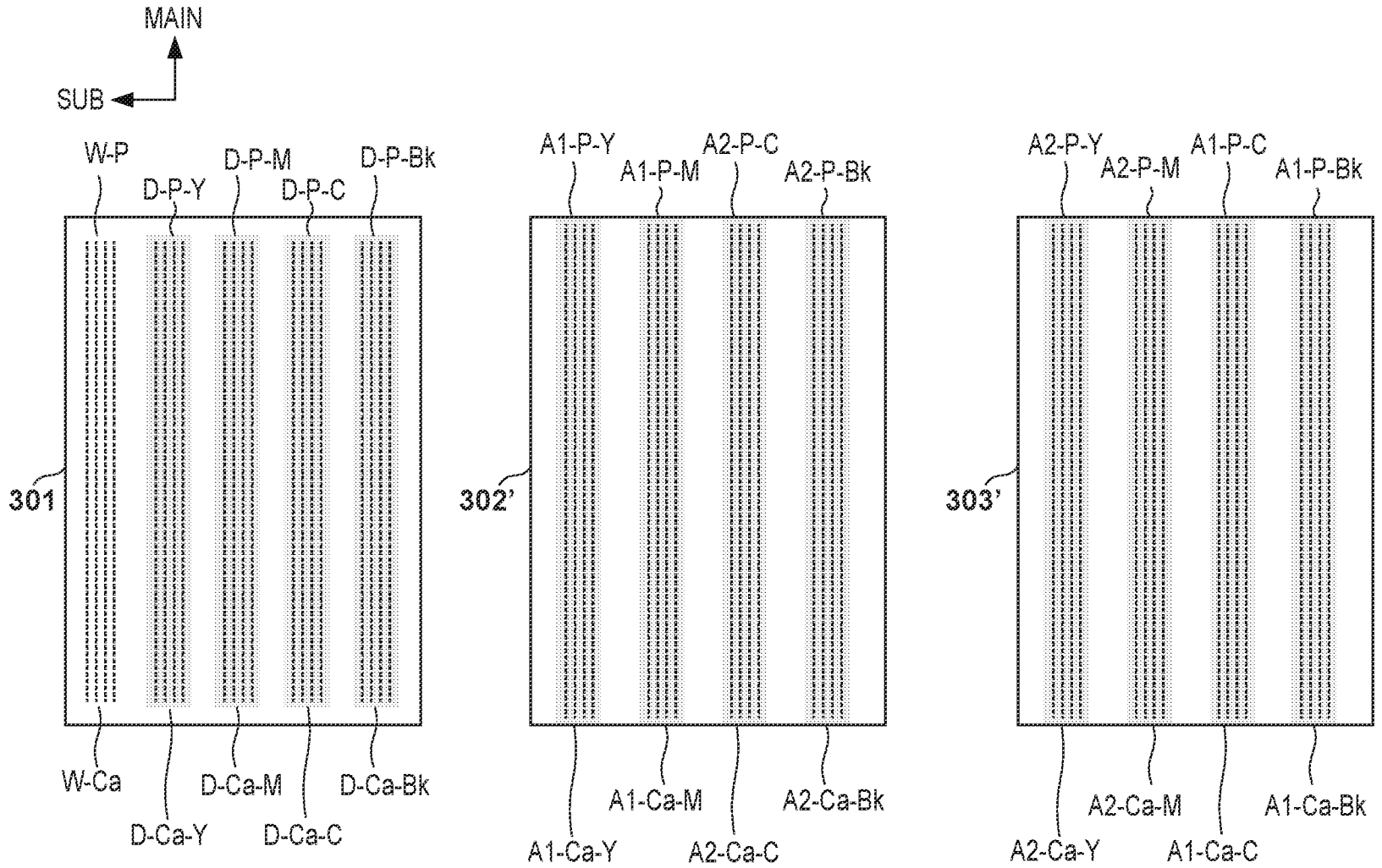
FIG. 17 is a view for describing arrangement of analog patterns.

FIG. 17 illustrates an arrangement of analog patterns A1-P and A2-P in the second embodiment. In the second embodiment, differences with the first embodiment are that the charts 302 and 303 are substituted by the charts 302' and 303'. In the chart 302' the analog patterns A1-P-Y and A1-P-M for which charging is applied, and the analog patterns A2-P-C and A2-P-Bk for which charging is not applied are formed. In the chart 303' the analog patterns A2-P-Y and A2-P-M for which charging is applied, and the analog patterns A1-P-C and A1-P-Bk for which charging is not applied are formed.

Two constraint conditions are imposed for colors that can be used for forming a camouflage pattern in the second embodiment. The first is that the color of a camouflage pattern must be a different color to the color of an analog pattern. For example, for the camouflage pattern A1-Ca-Y added to the yellow analog pattern A1-P-Y for which charging is applied in the chart 302', toner of color other than yellow must be used. In other words, a camouflage pattern must be formed using colors for one or more types of toner that are different from the color of toner used to form an analog pattern. The second is that, so that time for switching charging potentials is sufficiently guaranteed, a color of toner of an analog pattern A2-P formed without charging being applied for the same sheet (page) must not be used. For example, cyan and black are used for the analog patterns A2-P-C and A2-P-Bk for which charging is not applied. Accordingly, cyan and black must not be used for the camouflage pattern A1-Ca-Y. Therefore, only magenta can be used for the camouflage pattern A1-Ca-Y.

FIG. 18A is a table illustrating combinations of image pattern colors and camouflage pattern colors. Based on the above constraint conditions, only yellow can be used for the camouflage pattern A1-Ca-M that is added to the magenta analog pattern A1-P-M of the chart 302'. Only black can be used for the camouflage pattern A1-Ca-C that is added to the cyan analog pattern A1-P-C of the chart 303'. Only cyan can be used for the camouflage pattern A1-Ca-Bk that is added to the black analog pattern A1-P-Bk of the chart 303'.

For the camouflage pattern A2-Ca-C that is added to the cyan analog pattern A2-P-C for which charging is not applied with the chart 302', toner of a color other than cyan must be used based on the first condition. In addition, based on the second condition, the camouflage pattern A2-Ca-C which is added onto the analog pattern A2-P-C must not be cyan or black. Accordingly it must be a yellow monochrome or a magenta monochrome. For the camouflage pattern A2-Ca-Bk that is added to the black analog pattern A2-P-Bk for which charging is not applied with the chart 302', a yellow monochrome or a magenta monochrome must be used. For the camouflage pattern A2-Ca-Y that is added to the yellow analog pattern A2-P-Y for which charging is not applied with the chart 303', a cyan monochrome or a black monochrome must be used. For the camouflage pattern A2-Ca-M that is added to the magenta analog pattern A2-P-M for which charging is not applied with the chart 303', a cyan monochrome or a black monochrome must be used.

Incidentally, the analog patterns A1-P-Y, A1-P-M, A1-P-C, and A2-P-Bk may be formed on the chart 302', and the analog patterns A2-P-Y, A2-P-M, A2-P-C, and A1-P-Bk may be formed on the chart 303'. However, the above two constraint conditions are imposed even in this case.

FIG. 18B is a table illustrating combinations of image pattern colors and camouflage pattern colors. As illustrated by FIG. 18B, there are respective toner colors that can be formed on each camouflage pattern in the chart 302'. However, there is no toner color that can form the camouflage pattern A1-Ca-Bk in the chart 303'. In other words, it is not possible to add a camouflage pattern to the analog pattern A1-P-Bk. Accordingly, in a case of arranging the analog patterns A1-P for which charging is applied and the analog patterns A2-P for which charging is not applied on two charts, it should be advantageous to divide YMCBk into two groups of two colors.

[Replacement Part Identification Processing]

Figure 19A:
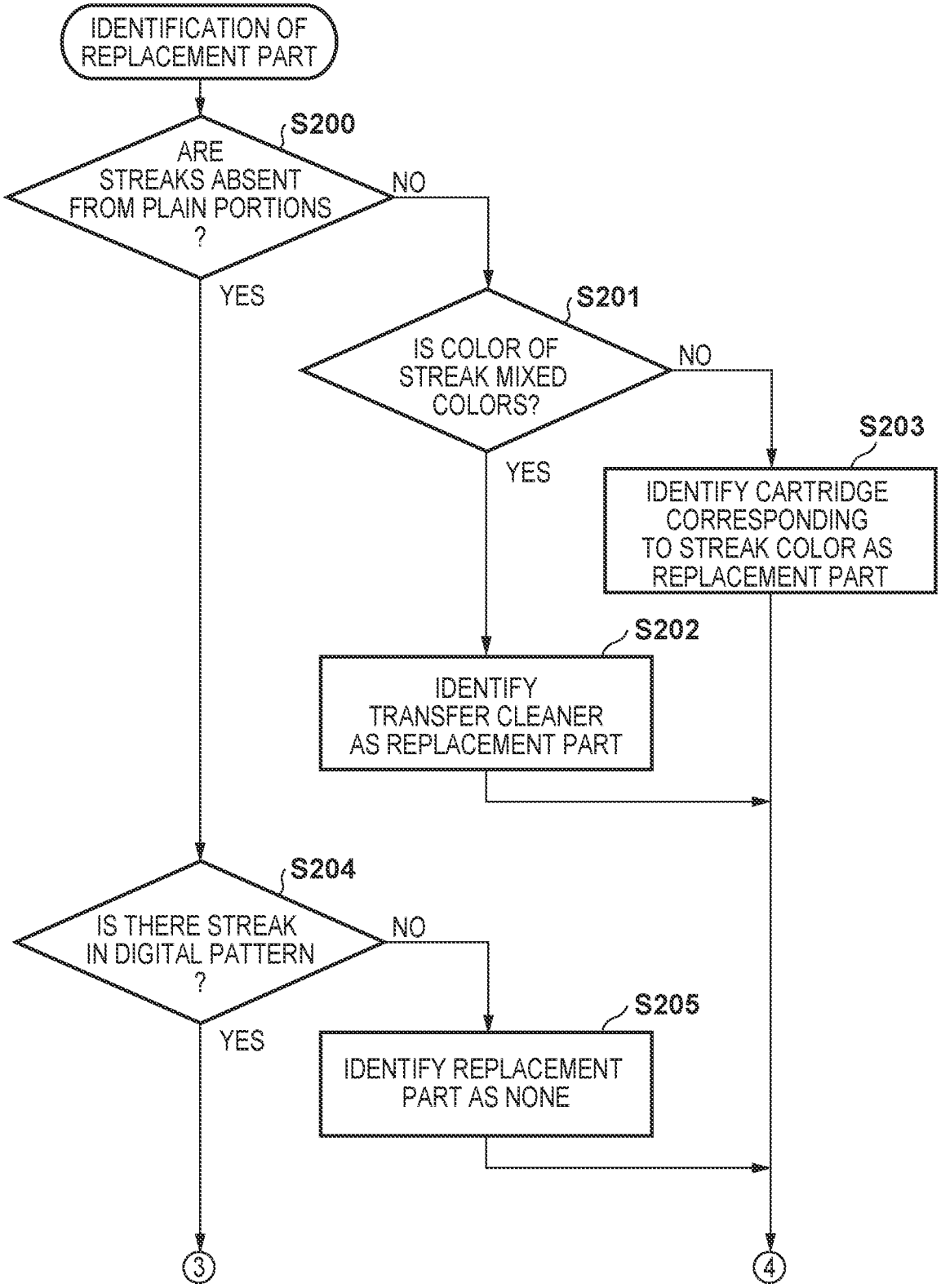
FIGS. 19A and 19B are flowcharts illustrating processing for identifying a replacement part.
Figure 19B:
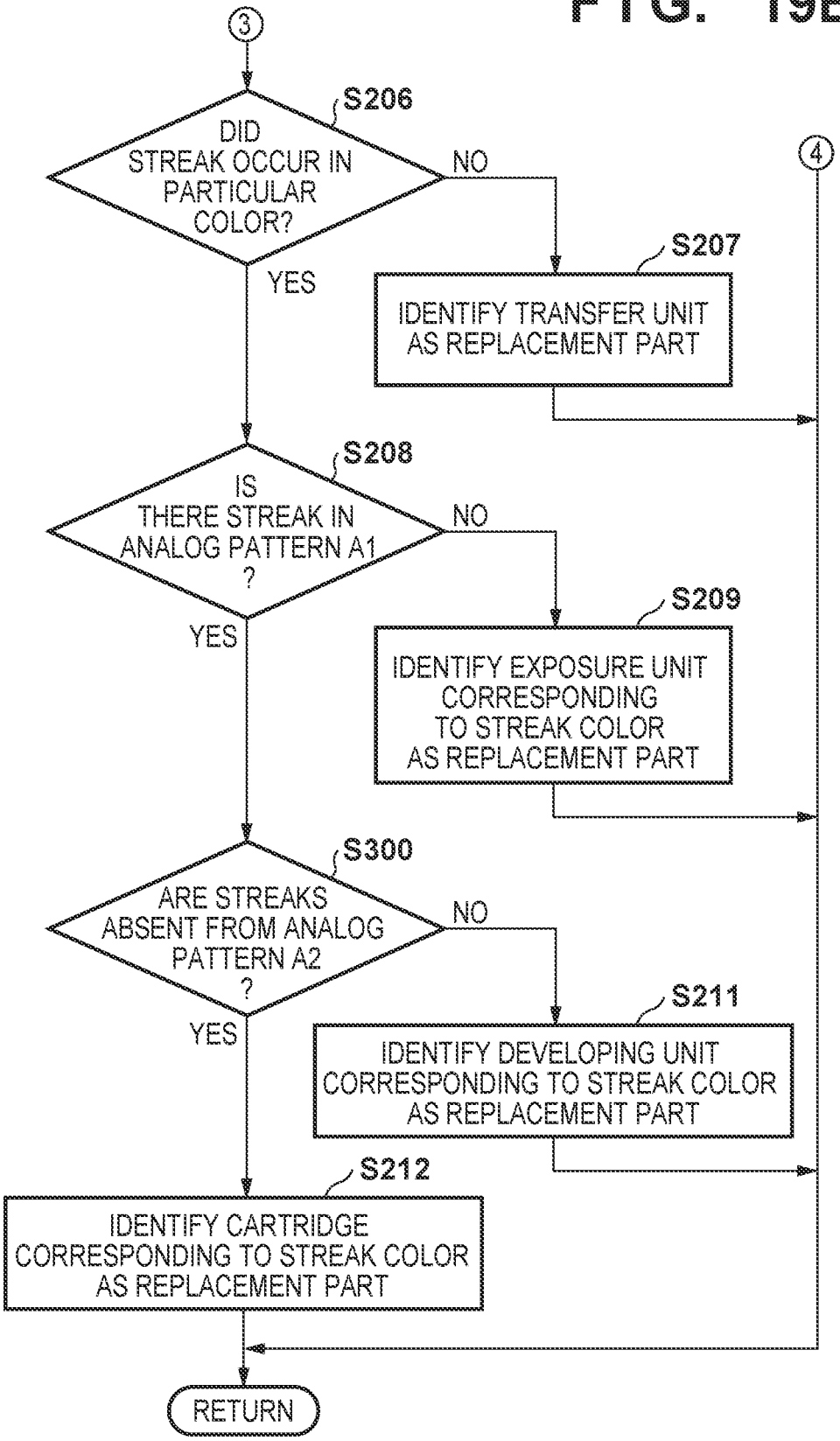

FIGS. 19A and 19B are flowcharts illustrating details of processing for identifying a replacement part and a response method. In FIGS. 19A and 16B, a difference with FIGS. 16A and 16B is that step S210 is substituted with step S300. In step S300, the CPU 60 reads feature amounts from the storage apparatus 63, and determines whether a streak is not present in the analog patterns A2-P. If there is a streak in the analog patterns A2-P, the CPU 60 advances to step S211. If there is no streak in the analog patterns A2-P, the CPU 60 advances to step S212. That is, if there is no streak in the analog patterns A2, the CPU 60 identifies a charge defect as the cause of the streak, and identifies the process cartridge 50 including the charger unit 12 as the replacement part. Also, the replacement part is a replacement part corresponding to the color of the streak. For example, if there is a streak in a yellow analog pattern A1-P but there is no streak in a yellow analog pattern A2-P, the process cartridge 50 that is responsible for yellow is identified as a replacement part.

In the second embodiment with such a configuration, the charts 302' and 303' which include the analog patterns A1-P formed by applying charging, and the analog patterns A2-P formed without charging being applied are generated. By this, it is possible to distinguish a streak caused by a slight charge defect and a streak caused by the developing unit 14. In this way, in the second embodiment, it becomes possible to reliably distinguish even if there is a slight charge defect that is difficult to distinguish by the first embodiment. In other words, it is possible to determine with high precision whether the cause of a streak is the charger unit 12 or the developing unit 14.

The second embodiment can also be applied to a case where charging is off (Vd_A2=0V), and not just a case where charging is on. As illustrated by FIG. 18A, by controlling the exposure unit 13, the CPU 60 uses toner of a color different from the color of toner of a first non-exposure image (for example: an analog pattern A1-P) to add to the first non-exposure image a camouflage pattern for obscuring an image defect that is not of interest. Furthermore, by controlling the exposure unit 13, the CPU 60 uses toner of a color different from the color of toner of a second non-exposure image (for example: an analog pattern A2-P) to add a camouflage pattern to the second non-exposure image. By this, it is possible to add a camouflage pattern to an analog pattern even with a low cost power supply that has a low speed for switching a charging potential or a developing potential.

Furthermore, by controlling the image forming unit 10, the CPU 60 may form on the chart 302', which is a first sheet, the first non-exposure image of a first color, the first non-exposure image of a second color, the second non-exposure image of a third color, and the second non-exposure image of the fourth color. Furthermore, by controlling the image forming unit 10, the CPU 60 may form on the chart 303', which is a second sheet, the first non-exposure image of a first color, the first non-exposure image of a second color, the second non-exposure image of a third color, and the second non-exposure image of the fourth color.

As illustrated by FIG. 18A, the colors of the camouflage patterns A1-Ca and A2-Ca are restricted. In the chart 302', the color of the camouflage pattern A1-Ca-Y added to the first non-exposure image of the first color is the second color. In the chart 302', the color of the camouflage pattern A1-Ca-M added to the first non-exposure image of the second color is the first color. In the chart 302', the color of the camouflage pattern A2-Ca-C added to the second non-exposure image of the third color is the first color or the second color. In the chart 302', the color of the camouflage pattern A2-Ca-Bk added to the second non-exposure image of the fourth color is the first color or the second color.

Similarly, in the chart 303', the color of the camouflage pattern A2-Ca-Y added to the second non-exposure image of the first color is the third color or the fourth color. In the chart 303', the color of the camouflage pattern A2-Ca-M added to the second non-exposure image of the second color is the third color or the fourth color. In the chart 303', the color of the camouflage pattern A1-Ca-C added to the first non-exposure image of the third color is the fourth color. In the chart 303', the color of the camouflage pattern A1-Ca-Bk added to the first non-exposure image of the fourth color is the third color.

The image forming unit 10 has a first image forming unit for forming a toner image using toner of the first color, and a second image forming unit for forming a toner image using toner of the second color. The image forming unit 10 has a third image forming unit for forming a toner image using toner of the third color, and a fourth image forming unit for forming a toner image using toner of the fourth color. For example, the first color is yellow, the second color is magenta, the third color is cyan, and the fourth color is black. Each image forming unit has a photosensitive drum 11, a charger unit 12, a developing unit 14, and a first cleaning unit (for example: the drum cleaner 15). An exposure unit (for example: the exposure unit 13) may be provided in each image forming unit, or a common exposure unit (for example: the exposure unit 13) may be provided for the four image forming units. Each developing unit 14 has a developing sleeve 142 for carrying a developing agent. As exemplified by the chart 302 of FIG. 3 or the like, by controlling the image forming unit 10, the CPU 60 may form, on a first sheet, the first non-exposure image of the first color, the first non-exposure image of the second color, the first non-exposure image of the third color, and the first non-exposure image of the fourth color. In addition, as illustrated by the chart 303 or the like, by controlling the image forming unit 10, the CPU 60 may form, on a second sheet, the second non-exposure image of the first color, the second non-exposure image of the second color, the second non-exposure image of the third color, and the second non-exposure image of the fourth color.

In addition, the image forming apparatus 1 is not limited to a configuration in which the image reader 2 reads a chart. It may have a configuration where the printer 3 has a sensor for reading a chart on a conveyance path for conveying a sheet. The sensor is provided downstream of the fixing device 40 in the conveyance direction of the sheet. The CPU 60 conveys the chart along the conveyance path to the sensor, and reads the chart by the sensor. By this configuration, there is no burden where a user or a service person places a chart on the platen glass 22 of the image reader 2.

The following aspects are derived from the above described inventions.

<Aspect 1> An image forming apparatus comprising:

a first image forming unit configured to form a first image, the first image forming unit including a first photosensitive member, a first charging unit that charges the first photosensitive member, a first exposure unit that exposes the first photosensitive member to form an electrostatic latent image, and a first developing sleeve that develops the electrostatic latent image on the first photosensitive member by using a developing agent of a first color;

a second image forming unit configured to form a second image, the second image forming unit including a second photosensitive member, a second charging unit that charges the second photosensitive member, a second exposure unit that exposes the second photosensitive member to form an electrostatic latent image, and a second developing sleeve that develops the electrostatic latent image on the second photosensitive member by using a developing agent of a second color different from first color;

a transfer portion at which the first image and the second image are transferred onto a sheet;

a sensor configured to read a test image formed on the sheet, the test image used for detecting a causal part of a streak occurring when an image is formed on the sheet by the image forming apparatus; and a controller configured to:

control the first image forming unit and the second image forming unit to form a test image having a pattern, wherein the test image is formed by the first image forming unit based on a first image forming condition in which an absolute value of a developing potential of the first developing sleeve is greater than an absolute value of a charging potential of the first photosensitive member, and wherein the pattern is formed by the second image forming unit based on a second image forming condition in which an absolute value of a developing potential of the second developing sleeve is smaller than an absolute value of a charging potential of the second photosensitive member; and control the sensor to read the test image having the pattern.

<Aspect 2> The image forming apparatus according to Aspect 1, wherein the controller controls the first image forming unit and the second image forming unit to form another test image having another pattern, the another test image is formed by the second image forming unit based on another second image forming condition in which the absolute value of the developing potential of the second developing sleeve is greater than the absolute value of the charging potential of the second photosensitive member, and the another pattern is formed by the first image forming unit based on another first image forming condition in which the absolute value of the developing potential of the first developing sleeve is smaller than the absolute value of the charging potential of the first photosensitive member.

<Aspect 3> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the controller controls the first image forming unit and the third image forming unit to form another test image having another pattern, the another test image is formed by the first image forming unit based on another first image forming condition in which the absolute value of the developing potential of the first developing sleeve is greater than an absolute value of a surface potential of the first photosensitive member without charging by the first charging unit, and the another pattern is formed by the third image forming unit based on a third image forming condition in which an absolute value of a developing potential of the third developing sleeve is smaller than an absolute value of a charging potential of the third photosensitive member.

<Aspect 4> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the pattern corresponds to a mixed color pattern formed by the second image forming unit and the third image forming unit, and the mixed color pattern is formed by the third image forming unit based on a third image forming condition in which an absolute value of a developing potential of the third developing sleeve is smaller than an absolute value of a charging potential of the third photosensitive member.

<Aspect 5> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the controller controls the first image forming unit and the third image forming unit to form another test image having another pattern, the another test image is formed by the third image forming unit based on a third image forming condition in which an absolute value of a developing potential of the third developing sleeve is larger than an absolute value of a charging potential of the third photosensitive member, and the another pattern is formed by the first image forming unit based on another first image forming condition in which the absolute value of the developing potential of the first developing sleeve is smaller than the absolute value of the charging potential of the first photosensitive member.

<Aspect 6> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the controller controls the first image forming unit and the third image forming unit to form another test image having another pattern, the another test image is formed by the third image forming unit based on a third image forming condition in which an absolute value of a developing potential of the third developing sleeve is larger than an absolute value of a charging potential of the third photosensitive member, and the another pattern is formed by the second image forming unit based on another second image forming condition where the absolute value of the developing potential of the second developing sleeve is smaller than the absolute value of the charging potential of the second photosensitive member.

<Aspect 7> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the controller controls the first image forming unit and the third image forming unit to form another test image having another pattern, the another test image is formed by the third image forming unit based on a third image forming condition in which an absolute value of a developing potential of the third developing sleeve is greater than an absolute value of a surface potential of the third photosensitive member without charging by the third charging unit, and the another pattern is formed by the first image forming unit based on another first image forming condition in which the absolute value of the developing potential of the first developing sleeve is smaller than the absolute value of the charging potential of the first photosensitive member.

<Aspect 8> The image forming apparatus according to Aspect 1, further comprising a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color differs from the first color and differs from the second color, the controller controls the first image forming unit and the third image forming unit to form another test image having another pattern, the another test image is formed by the third image forming unit based on a third image forming condition in which an absolute value of a developing potential of the third developing sleeve is greater than an absolute value of a surface potential of the third photosensitive member without charging by the third charging unit, and the another pattern is formed by the second image forming unit based on another second image forming condition in which the absolute value of the developing potential of the second developing sleeve is smaller than the absolute value of the charging potential of the second photosensitive member.

<Aspect 9> The image forming apparatus according to Aspect 1, wherein a color difference ΔE00 between the pattern and the test image is 3.0 or more.

<Aspect 10> The image forming apparatus according to Aspect 1, wherein the pattern obscures an image defect occurring when the test image is formed by the first image forming unit.

<Aspect 11> The image forming apparatus according to Aspect 1, wherein a test image having the pattern includes a region where the pattern is formed and a region where the pattern is not formed.

<Aspect 12> The image forming apparatus according to Aspect 1, wherein the controller detects the causal part based on a result of reading a test image having the pattern.

<Aspect 13> The image forming apparatus according to Aspect 1, further comprising a display, wherein the controller displays the detected causal part on the display.

<Aspect 14> An image forming apparatus comprising:

a first image forming unit configured to form a first image, the first image forming unit including a first photosensitive member, a first charging unit that charges the first photosensitive member, a first exposure unit that exposes the first photosensitive member to form an electrostatic latent image, and a first developing sleeve that develops the electrostatic latent image on the first photosensitive member by using a developing agent of a first color;

a second image forming unit configured to form a second image, the second image forming unit including a second photosensitive member, a second charging unit that charges the second photosensitive member, a second exposure unit that exposes the second photosensitive member to form an electrostatic latent image, and a second developing sleeve that develops the electrostatic latent image on the second photosensitive member by using a developing agent of a second color different from first color;

a transfer portion at which the first image and the second image are transferred onto a sheet;

a sensor configured to read a test image formed on the sheet, the test image being used for detecting a causal part of a streak occurring when an image is formed on the sheet by the image forming apparatus; and a controller configured to:

control the first image forming unit and the second image forming unit to form a test image having a pattern, wherein the test image is formed by the first image forming unit based on a first image forming condition in which an absolute value of a developing potential of the first developing sleeve is greater than an absolute value of a surface potential of the first photosensitive member without charging by the first charging unit, and wherein the pattern is formed by the second image forming unit based on a second image forming condition in which an absolute value of a developing potential of the second developing sleeve is smaller than an absolute value of a charging potential of the second photosensitive member; and read the test image having the pattern by the sensor.

<Aspect 15> The image forming apparatus according to Aspect 14, wherein the controller controls the first image forming unit and the second image forming unit to form another test image having another pattern, the another test image is formed by the second image forming unit based on another second image forming condition in which the absolute value of the developing potential of the second developing sleeve is greater than an absolute value of a surface potential of the second photosensitive member without charging by the second charging unit, and the another pattern is formed by the first image forming unit based on another first image forming condition in which the absolute value of the developing potential of the first developing sleeve is smaller than the absolute value of the charging potential of the first photosensitive member.

<Aspect 16> The image forming apparatus according to Aspect 14, wherein a color difference ΔE00 between the pattern and the test image is 3.0 or more.

<Aspect 17> The image forming apparatus according to Aspect 14, wherein the pattern obscures an image defect occurring when the test image is formed by the first image forming unit.

<Aspect 18> The image forming apparatus according to Aspect 14, wherein a test image having the pattern includes a region where the pattern is formed and a region where the pattern is not formed.

<Aspect 19> The image forming apparatus according to Aspect 14, wherein the controller detects the causal part based on a result of reading a test image having the pattern.

<Aspect 20> The image forming apparatus according to Aspect 14, further comprising a display, wherein the controller displays the detected causal part on the display.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-1517578 filed Aug. 4, 2017, which is hereby incorporated by reference herein in its entirety.

What is claimed is:

1. An image forming apparatus comprising:

a first image forming unit configured to form a first image, the first image forming unit including a first photosensitive member, a first charging unit that charges the first photosensitive member, a first exposure unit that exposes the first photosensitive member to form an electrostatic latent image, and a first developing sleeve that develops the electrostatic latent image on the first photosensitive member by using a developing agent of a first color;

a second image forming unit configured to form a second image, the second image forming unit including a second photosensitive member, a second charging unit that charges the second photosensitive member, a second exposure unit that exposes the second photosensitive member to form an electrostatic latent image, and a second developing sleeve that develops the electrostatic latent image on the second photosensitive member by using a developing agent of a second color different from first color; and a controller configured to control the first image forming unit and the second image forming unit to form a test image having a pattern on a sheet, wherein the pattern overlaps the test image, wherein the test image is formed by the first image forming unit based on a first image forming condition in which an absolute value of a developing potential of the first developing sleeve is greater than an absolute value of a charging potential of the first photosensitive member, wherein the pattern is formed by the second image forming unit based on a second image forming condition in which an absolute value of a developing potential of the second developing sleeve is less than an absolute value of a charging potential of the second photosensitive member, and wherein the pattern is formed by exposing with the second exposure unit.

2. The image forming apparatus according to claim 1, wherein the controller controls the first image forming unit and the second image forming unit to form another test image having another pattern on the sheet, the other pattern overlaps the other test image, the other test image is formed by the second image forming unit based on another second image forming condition in which the absolute value of the developing potential of the second developing sleeve is greater than the absolute value of the charging potential of the second photosensitive member, the other pattern is formed by the first image forming unit based on another first image forming condition in which the absolute value of the developing potential of the first developing sleeve is less than the absolute value of the charging potential of the first photosensitive member, and the other pattern is formed by exposing with the first exposure unit.

3. The image forming apparatus according to claim 1, further comprising:

a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color is different from the first color and the second color, the controller controls the first image forming unit and the third image forming unit to form another test image having another pattern on the sheet, the other pattern overlaps the other test image, the other test image is formed by the first image forming unit based on another first image forming condition in which the absolute value of the developing potential of the first developing sleeve is greater than an absolute value of a surface potential of the first photosensitive member without charging by the first charging unit, the other pattern is formed by the third image forming unit based on a third image forming condition in which an absolute value of a developing potential of the third developing sleeve is less than an absolute value of a charging potential of the third photosensitive member, and the other pattern is formed by exposing with the third exposure unit.

4. The image forming apparatus according to claim 1, further comprising:

a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color is different from the first color and the second color, the pattern is a mixed color pattern formed by the second image forming unit and the third image forming unit, the mixed color pattern is formed by the third image forming unit based on a third image forming condition in which an absolute value of a developing potential of the third developing sleeve is less than an absolute value of a charging potential of the third photosensitive member, and wherein the mixed color pattern is formed by exposing with the third exposure unit.

5. The image forming apparatus according to claim 1, further comprising:

a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color is different from the first color and the second color, the controller controls the first image forming unit and the third image forming unit to form another test image having another pattern on the sheet, the other pattern overlaps the other test image, the other test image is formed by the third image forming unit based on a third image forming condition in which an absolute value of a developing potential of the third developing sleeve is greater than an absolute value of a charging potential of the third photosensitive member, the other pattern is formed by the first image forming unit based on another first image forming condition in which the absolute value of the developing potential of the first developing sleeve is less than the absolute value of the charging potential of the first photosensitive member, and the other pattern is formed by exposing with the first exposure unit.

6. The image forming apparatus according to claim 1, further comprising:

a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color is different from the first color and the second color, the controller controls the second image forming unit and the third image forming unit to form another test image having another pattern on the sheet, the other pattern overlaps the other test image, the other test image is formed by the third image forming unit based on a third image forming condition in which an absolute value of a developing potential of the third developing sleeve is greater than an absolute value of a charging potential of the third photosensitive member, the other pattern is formed by the second image forming unit based on another second image forming condition in which the absolute value of the developing potential of the second developing sleeve is less than the absolute value of the charging potential of the second photosensitive member, and the other pattern is formed by exposing with the second exposure unit.

7. The image forming apparatus according to claim 1, wherein a color difference $\Delta E00$ between the pattern and the test image is 3.0 or more.

8. The image forming apparatus according to claim 1, wherein the pattern obscures an image defect occurring when the test image is formed by the first image forming unit.

9. The image forming apparatus according to claim 1, wherein the controller obtains read data related to the test image having the pattern, the read data being output from a sensor, and the controller detects, based on the read data, a causal part of a streak occurring when an image is formed on the sheet by the image forming apparatus.

10. An image forming apparatus comprising:

a first image forming unit configured to form a first image, the first image forming unit including a first photosensitive member, a first charging unit that charges the first photosensitive member, a first exposure unit that exposes the first photosensitive member to form an electrostatic latent image, and a first developing sleeve that develops the electrostatic latent image on the first photosensitive member by using a developing agent of a first color;

a second image forming unit configured to form a second image, the second image forming unit including a second photosensitive member, a second charging unit that charges the second photosensitive member, a second exposure unit that exposes the second photosensitive member to form an electrostatic latent image, and a second developing sleeve that develops the electrostatic latent image on the second photosensitive member by using a developing agent of a second color different from first color; and a controller configured to control the first image forming unit and the second image forming unit to form a test image having a pattern on a sheet, wherein the pattern overlaps the test image, wherein the test image is formed by the first image forming unit based on a first image forming condition in which an absolute value of a developing potential of the first developing sleeve is greater than an absolute value of a surface potential of the first photosensitive member without charging by the first charging unit, wherein the pattern is formed by the second image forming unit based on a second image forming condition in which an absolute value of a developing potential of the second developing sleeve is less than an absolute value of a charging potential of the second photosensitive member, and wherein the pattern is formed by exposing with the second exposure unit.

11. The image forming apparatus according to claim 10, wherein the controller controls the first image forming unit and the second image forming unit to form another test image having another pattern on the sheet, the other pattern overlaps the other test image, the other test image is formed by the second image forming unit based on another second image forming condition in which the absolute value of the developing potential of the second developing sleeve is greater than an absolute value of a surface potential of the second photosensitive member without charging by the second charging unit, the other pattern is formed by the first image forming unit based on another first image forming condition in which the absolute value of the developing potential of the first developing sleeve is less than the absolute value of the charging potential of the first photosensitive member, and the other pattern is formed by exposing with the first exposure unit.

12. The image forming apparatus according to claim 10, wherein a color difference ΔE00 between the pattern and the test image is 3.0 or more.

13. The image forming apparatus according to claim 10, wherein the pattern obscures an image defect occurring when the test image is formed by the first image forming unit.

14. The image forming apparatus according to claim 10, wherein the controller obtains read data related to the test image having the pattern, the read data being output from a sensor, and the controller detects, based on the read data, a causal part of a streak occurring when an image is formed on the sheet by the image forming apparatus.

15. The image forming apparatus according to claim 1, wherein the controller obtains read data related to the test image having the pattern, the read data being output from a sensor, the controller detects a streak occurring in the test image based on the read data, and a direction in which the streak extends is parallel to a direction in which the sheet is conveyed in the image forming apparatus.

16. The image forming apparatus according to claim 1, wherein the controller controls the first image forming unit and the second image forming unit to form another test image having another pattern on the sheet, the other pattern overlaps the other test image, the other test image is formed by the first image forming unit based on another first image forming condition in which the absolute value of the developing potential of the first developing sleeve is greater than the absolute value of a surface potential of the first photosensitive member without charging by the first charging unit, the other pattern is formed by the second image forming unit based on another second image forming condition in which the absolute value of the developing potential of the second developing sleeve is less than the absolute value of the charging potential of the second photosensitive member, and the other pattern is formed by exposing with the second exposure unit.

17. The image forming apparatus according to claim 1, further comprising:

a third image forming unit configured to form a third image, the third image forming unit including a third photosensitive member, a third charging unit that charges the third photosensitive member, a third exposure unit that exposes the third photosensitive member to form an electrostatic latent image, and a third developing sleeve that develops the electrostatic latent image on the third photosensitive member by using a developing agent of a third color, wherein the third color is different from the first color and the second color, the controller controls the first image forming unit and the third image forming unit to form another test image having another pattern on the sheet, the other pattern overlaps the other test image, the other test image is formed by the first image forming unit based on another first image forming condition in which the absolute value of the developing potential of the first developing sleeve is greater than the absolute value of a surface potential of the first photosensitive member without charging by the first charging unit, the other pattern is formed by the third image forming unit based on another third image forming condition in which the absolute value of the developing potential of the third developing sleeve is less than the absolute value of the charging potential of the third photosensitive member, and the other pattern is formed by exposing with the third exposure unit.

18. The image forming apparatus according to claim 11, wherein the controller obtains read data related to the test image having the pattern, the read data being output from a sensor, the controller detects a streak occurring in the test image based on the read data, and a direction in which the streak extends is parallel to a direction in which the sheet is conveyed in the image forming apparatus.

19. An imaging forming apparatus comprising:

a first image forming unit configured to form a first image, the first image forming unit including a first photosensitive member, a first charging unit that charges the first photosensitive member based on a first charging potential, a first exposure unit that exposes the first photosensitive member to form an electrostatic latent image, and a first developing sleeve that develops the electrostatic latent image on the first photosensitive member based on a first developing potential by using a developing agent of a first color, a second image forming unit configured to form a second image, the second image forming unit including a second photosensitive member, a second charging unit that charges the second photosensitive member based on a second charging potential, a second exposure unit that exposes the second photosensitive member to form an electrostatic latent image, and a second developing sleeve that develops the electrostatic latent image on the second photosensitive member based on a second developing potential by using a developing agent of a second color different from first color; and a controller configured to control the first image forming unit and the second image forming unit to form a test image having a pattern on a sheet, wherein the pattern overlaps the test image, wherein the developing agent of the first color and the developing agent of the second color are charged to a negative polarity, wherein, in a case in which the test image having the pattern is formed, the controller controls the first charging unit to charge the first photosensitive member based on a test image charging potential, controls the first developing sleeve based on a test image developing potential, controls the second exposure unit to expose the second photosensitive member charged by the second charging unit, and controls the second developing sleeve based on a pattern developing potential, wherein a value of the test image charging potential, a value of the test image developing potential, a value of the pattern charging potential, and a value of the pattern developing potential are less than 0, wherein the value of the test image developing potential is less than the value of a surface potential of the first photosensitive member charge by the first charging unit based on the test image charging potential, and wherein the value of the pattern developing potential is greater than the value of a surface potential of the second photosensitive member charged by the second charging unit based on the pattern charging potential.

20. The image forming apparatus according to claim 19, wherein, in a case in which the test image having the pattern is formed, the first exposure unit does not expose the first photosensitive member.

21. The image forming apparatus according to claim 19, wherein the pattern obscures an image defect occurring when the test image is formed.

22. The image forming apparatus according to claim 19, wherein the controller obtains read data related to the test image having the pattern, the read data being output from a sensor, and the controller detects, based on the read data, a casual part of a streak occurring when an image is formed by the image forming apparatus.

* * * * *